US008182405B2

(12) United States Patent
Kurachi et al.

(10) Patent No.: US 8,182,405 B2
(45) Date of Patent: May 22, 2012

(54) DEVELOPING ROLLER, DEVELOPING ROLLER PRODUCTION METHOD, PROCESS CARTRIDGE, AND ELECTROPHOTOGRAPHIC APPARATUS

(75) Inventors: Masahiro Kurachi, Mishima (JP); Masaki Yamada, Mishima (JP); Yuji Sakurai, Susono (JP); Minoru Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 467 days.

(21) Appl. No.: 12/557,619

(22) Filed: Sep. 11, 2009

(65) Prior Publication Data

US 2010/0080611 A1 Apr. 1, 2010

(30) Foreign Application Priority Data

Sep. 30, 2008 (JP) ..... 2008-252917

(51) Int. Cl.
*B25C 1/08* (2006.01)
*B21K 1/02* (2006.01)
*G03G 15/08* (2006.01)

(52) U.S. Cl. ..... 492/18; 29/895.3; 29/895.32; 29/895; 492/53; 492/48; 492/56

(58) Field of Classification Search ..... 492/18, 492/48, 53, 56, 59; 399/286; 29/895, 895.3, 29/895.32, 895.33
See application file for complete search history.

(56) References Cited

U.S. PATENT DOCUMENTS

| | | | | |
|---|---|---|---|---|
| 5,434,653 | A | 7/1995 | Takizawa et al. | |
| 5,903,808 | A | 5/1999 | Takizawa et al. | |
| 7,099,613 | B2 | 8/2006 | Nakamura et al. | |
| 7,127,200 | B2 | 10/2006 | Nakamura et al. | |
| 7,347,808 | B2 * | 3/2008 | Beach et al. | 492/56 |
| 7,570,905 | B2 | 8/2009 | Kusaba et al. | |
| 7,580,660 | B2 * | 8/2009 | Sato et al. | 399/286 |
| 7,727,134 | B2 * | 6/2010 | Nakamura et al. | 492/18 |
| 7,797,833 | B2 * | 9/2010 | Nakamura et al. | 29/895.32 |
| 7,798,948 | B2 * | 9/2010 | Kawamura et al. | 492/18 |
| 2002/0028096 | A1 | 3/2002 | Satoh et al. | |
| 2008/0146427 | A1 * | 6/2008 | Osaku | 492/56 |
| 2009/0041499 | A1 * | 2/2009 | Sato et al. | 399/111 |

FOREIGN PATENT DOCUMENTS

| | | | |
|---|---|---|---|
| JP | 8-208087 | A | 8/1996 |
| JP | 9-12192 | A | 1/1997 |
| JP | 2000-112212 | A | 4/2000 |
| WO | 2008/109793 | A1 | 9/2008 |

* cited by examiner

*Primary Examiner* — Essama Omgba
(74) *Attorney, Agent, or Firm* — Fitzpatrick, Cella, Harper & Scinto

(57) ABSTRACT

A developing roller is provided which supplies a toner to a photosensitive member to develop an electrostatic latent image formed on the photosensitive member. The developing roller has a surface layer which includes carbon black and a polyurethane resin. The polyurethane resin has a specific structure. The surface layer has a specific ester group concentration and a specific urethane group concentration.

6 Claims, 3 Drawing Sheets

DEVELOPING ROLLER, DEVELOPING ROLLER PRODUCTION METHOD, PROCESS CARTRIDGE, AND ELECTROPHOTOGRAPHIC APPARATUS

BACKGROUND OF THE INVENTION

1. Field of the Invention

The present invention relates to a developing roller, and a method for producing a developing roller used in contact with a photosensitive member set in an electrophotographic apparatus such as a receiving apparatus of a copying machine, a printer and a facsimile. Further, the present invention relates to a process cartridge and electrophotographic apparatus which use this developing roller.

2. Description of the Related Art

Japanese Patent Application Laid-Open Nos. H9-12192 and H8-208087 disclose a developing roller used in an electrophotographic apparatus which has a mandrel and an elastic layer including polyurethane obtained by reacting a polyol and a polyisocyanate on the periphery of the mandrel.

Developing rollers are required to have as a basic function a function of frictionally charging toner to a suitable level. However, in a low-temperature low-humidity environment, for example, in an environment with a temperature of 10° C. and a humidity of 10% RH, the frictional chargeability of the toner becomes too high in some cases. This can cause toner to locally adhere electrostatically to the developing roller surface. Consequently, spotty unevenness (hereinafter referred to also as "blotching") may occur in the electrophotographic image.

When being set in the process cartridge or electrophotographic apparatus, developing rollers may be left standing in contact with a development blade or a photosensitive member in a static state for a long time period. In such a case, deformation which is not easily restored (hereinafter referred to as "permanent compression set") may occur at the portions coming in contact with the development blade or photosensitive member of the developing roller having the above-described urethane resin layer as a surface layer. The permanent compression set especially tends to occur in a high-temperature high-humidity environment, for example an environment with a temperature of 40° C. and a humidity of 95% RH. This is thought to be for the reason the surface of the developing roller tends to become flexible in a high-temperature high-humidity environment.

SUMMARY OF THE INVENTION

The present inventors have found from their investigation that the frictional charging of the toner on the surface layer can be adjusted by incorporating a polyolefin resin in a polyurethane resin-containing surface layer. However, since such a surface layer is easily made flexible, the surface layer may be permanently deformed when a developing roller including such a surface layer abuts the photosensitive member in a static state for a long time period in a high-temperature high-humidity environment. Therefore, the present inventors have discovered that in order to stably produce a high-quality electrophotographic image, it is important for a developing roller surface layer including a urethane resin as a binder resin to satisfy both the following characteristics 1 and 2.

1. Frictional chargeability of toner does not easily become excessive in a low-temperature low-humidity environment.

2. Permanent compression set does not easily occur in a high-temperature high-humidity environment.

The present invention is directed to providing a developing roller which includes a surface layer satisfying the above-described requirements 1 and 2 at a high level, and a method for producing the developing roller. Further, the present invention is directed to providing an electrophotographic apparatus and a process cartridge which can stably provide a high-quality electrophotographic image.

As a result of various investigations, the present inventors have discovered that a surface layer which includes a urethane resin and in which an ester group concentration and a urethane group concentration in a thickness direction are optimized, can satisfy the above-described requirements 1 and 2 at a high level, thereby arriving at the present invention.

According to one aspect of the present invention, there is provided a developing roller for supplying a toner to a photosensitive member to develop an electrostatic latent image formed on the photosensitive member, provided with a surface layer comprising carbon black and a polyurethane resin, wherein the polyurethane resin has at least one selected from the structures represented by the following chemical formulae (a) and (b) and at least one skeleton selected from a polybutadiene skeleton and a polyisoprene skeleton:

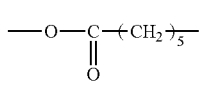

(a)

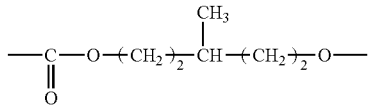

(b)

and wherein the surface layer comprises 18 parts by mass or more and 30 parts by mass or less of carbon black based on 100 parts by mass of the polyurethane resin, and where the thickness of the surface layer is t, the surface of the surface layer is X, the depth at a position of t/4 from the surface of the surface layer is Y and a depth at a position of t/2 from the surface of the surface layer is Z, the following expressions (1) to (4) are simultaneously satisfied:

$$7.5 \leqq EcX \leqq 10.0 \quad (1)$$

$$11.0 \leqq EcZ \leqq 14.0 \quad (2)$$

$$EcX \leqq EcY \leqq EcZ \quad (3)$$

$$0.5 \leqq UrcX \leqq 2.0 \quad (4)$$

(in equations (1) to (3), EcX, EcY, and EcZ are ester group concentrations at the positions X, Y and Z, respectively, and in equation (4), UrcX is a urethane group concentration at the surface X).

According to another aspect of the present invention, a process cartridge is provided which includes the above developing roller and a photosensitive drum placed in contact with the developing roller, and is attachable to and detachable from the main body of an electrophotographic apparatus.

According to still another aspect of the present invention, an electrophotographic apparatus is provided including the above developing roller and a photosensitive drum placed in contact with the developing roller.

According to the present invention, a developing roller can be provided which has a surface layer capable of achieving the compatibility between the inhibition of the occurrence of permanent compression set in a high-temperature high-humidity environment and the inhibition of excessive frictional charging of the toner in a low-temperature low-humidity environment. Further, according to the present invention, an electrophotographic apparatus and a process cartridge can be provided which stably produce a high-quality electrophotographic image.

Further features of the present invention will become apparent from the following description of exemplary embodiments.

DESCRIPTION OF THE EMBODIMENTS

Figure 1:
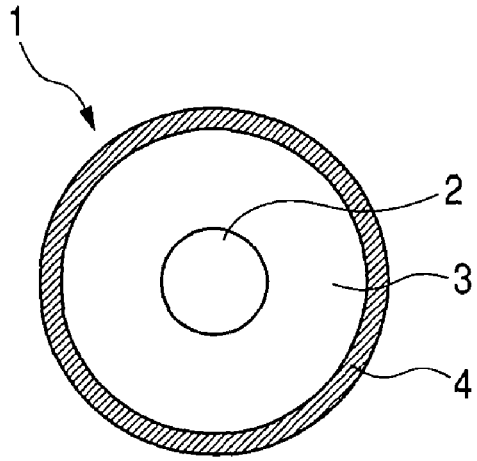
FIG. 1 is a cross-sectional view in the direction perpendicular to the axis of a developing roller according to the present invention.

FIG. 1 is a cross-sectional view in the direction perpendicular to the axis of a developing roller according to the present invention. A developing roller 1 has a conductive mandrel 2, a resin layer 3 formed on the periphery of the mandrel, and a surface layer 4 formed on the periphery of the resin layer.

<Surface Layer 4>

The surface layer includes carbon black and a polyurethane resin. This polyurethane resin has at least one selected from the structures represented by the following chemical formulae (a) and (b) and at least one skeleton selected from a polybutadiene skeleton and a polyisoprene skeleton.

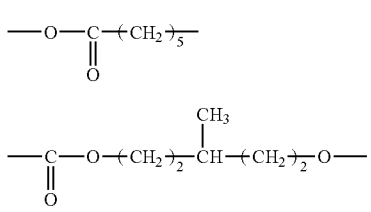

(a)

(b)

The surface layer includes 18 parts by mass or more and 30 parts by mass or less of carbon black based on 100 parts by mass of the polyurethane resin.

Further, where the thickness of the surface layer is t, the surface of the surface layer is X, the depth at a position of t/4 from the surface is Y and the depth at a position of t/2 from the surface is Z, the following expressions (1) to (4) are simultaneously satisfied:

$$7.5 \leqq EcX \leqq 10.0 \quad (1)$$

$$11.0 \leqq EcZ \leqq 14.0 \quad (2)$$

$$EcX \leqq EcY \leqq EcZ \quad (3)$$

$$0.5 \leqq UrcX \leqq 2.0 \quad (4).$$

In expressions (1) to (3), EcX, EcY, and EcZ are the ester group concentrations at the positions X, Y, and Z, respectively. In expression (4), UrcX is the urethane group concentration at the above-described position X).

The above-described ester group concentration is defined below. In addition, [COO bond percentage (%)], [NH bond percentage (%)], and [C—C bond percentage (%)] are values measured by ESCA (X-ray photoelectron spectroscopy).

Ester group concentration={[COO bond percentage (%)]−[NH bond percentage (%)]}/[C—C bond percentage (%)]×100

Further, the urethane group concentration is defined as follows.

Urethane group concentration=N (nitrogen) element atom % measured by ESCA

The term "polyurethane resin" does not indicate a polymer having a single composition, but is a general term for polymers having urethane bonds. Polyurethane resins are formed from hard segments such as urethane bonds, allophanate bonds, biuret bonds, etc., and soft segments. Polyurethanes are usually classified as polyester polyurethane, polyether polyurethane, polycarbonate polyurethane, acrylic polyurethane, polyolefin polyurethane, etc., according to the types of chemical bonds forming the soft segments.

The polyurethane resin according to the present invention is a polyurethane resin which has been thermally cured. A surface layer including a thermoset polyurethane resin as a binder can reduce the permanent compression set of the surface layer and is superior in wear resistance and frictional charging performance of toner to a surface layer including a thermoplastic or uncured polyurethane resin as the binder.

The polyurethane resin according to the present invention has at least one selected from the structures represented by the following chemical formulae (a) and (b) and at least one skeleton selected from a polybutadiene skeleton and a polyisoprene skeleton:

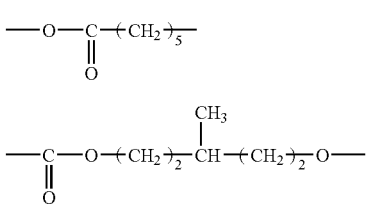

(a)

(b)

In the urethane resin, the structures represented by chemical formulae (a) and (b) are considered to contribute to setting an appropriate level for the mechanical properties of the surface layer, and the polybutadiene skeleton and polyisoprene skeleton are considered to contribute to setting an appropriate level for the performance of frictionally charging toner on the surface layer.

The chemical formulae (a) and (b) are units containing the ester group constituting the soft segment in the polyurethane resin. These units have a strong influence on the polarity of the resin material. Especially, a resin material having such a unit exhibits higher hydrophilicity than a resin material such as polyolefin or polyether polyurethane. Further, the structure of the soft segment has a strong influence on the properties of the polyurethane resin, especially the mechanical properties. Due to the unit containing an ester group which is represented by the chemical formula (a) or (b), the interchain force and the bonds between the polymer chains become stronger. Consequently, the polyurethane resin is excellent in wear resistance, Young's modulus, and break strength.

Further, factors such as the above-described ester group concentration and the presence of side chains such as a methyl group influence the crystallinity of the soft segment. The crystallinity also has an influence on the mechanical properties of the polyurethane resin.

The urethane resin material containing at least one skeleton selected from a polybutadiene skeleton and a polyisoprene skeleton is generally classified as a polyolefin resin. Generally, polyolefin resins exhibit higher hydrophobicity than polyester resins, and are not easily polarized because they do not contain an oxygen atom in the soft segment structures except for the end groups. Further, polyolefin resins have comparatively lower charge imparting properties. However, polyolefin resins are weak in chemical bond strength, and are inferior in mechanical strength to resin materials such as polyether, polyester, acrylic and polycarbonate urethane,. In particular, the number of carbon atoms in the aliphatic moiety of the polyester is known to bring about the so-called odd-even effect, which affects the fundamental properties of the polymer.

The present inventors have discovered that the mechanical strength of the surface layer and the charging performance of the toner can be optimized by using, as a binder resin in the surface layer of the developing roller, a urethane resin which includes a unit represented by chemical formula (a) or (b), and a polybutadiene skeleton or a polyisoprene skeleton, and adjusting as below the ester group concentration and urethane group concentration in the thickness direction of the surface layer.

In the surface layer according to the present invention, where the thickness of the surface layer is t, the surface of the surface layer is X, the depth at a position of t/4 from the surface is Y, and the depth at a position of t/2 from the surface is Z, the following expressions (1) to (4) are simultaneously satisfied:

$$7.5 \leqq EcX \leqq 10.0 \quad (1);$$

$$11.0 \leqq EcZ \leqq 14.0 \quad (2);$$

$$EcX \leqq EcY \leqq EcZ \quad (3);$$

$$0.5 \leqq UrcX \leqq 2.0 \quad (4).$$

In expressions (1) to (3), EcX, EcY, and EcZ are the ester group concentrations at the positions X, Y, and Z, respectively. In expression (4), UrcX is the urethane group concentration at the above-described position X).

The above-described ester group concentration is defined as below.

Ester group concentration={[COO bond percentage (%)]=[NH bond percentage (%)]}/[C—C bond percentage (%)]×100

In this case, [COO bond percentage (%)], [NH bond percentage (%)], and [C—C bond percentage (%)] are values measured by ESCA (X-ray photoelectron spectroscopy).

Further, the urethane group concentration is defined as follows.

Urethane group concentration=N (nitrogen) element atom % measured by ESCA.

As represented by the above formulae (1) to (3), the concentration of ester groups increases in the depth direction of the surface layer. In other words, the nearer to the surface of the surface layer, the higher the concentration of the polybutadiene skeleton or polyisoprene skeleton.

Further, the ester group concentration (EcX, EcY, and EcZ) and the urethane group concentration (UrcX) in the polyurethane resin are each in a specific range, and thus the surface layer is reduced in permanent compression set and excessive charging of toner can be inhibited.

Since the structures represented by the chemical formulae (a) and (b) each include an ester group which has strong interchain force, a polyurethane resin including a structure represented by at least one selected from the chemical formulae (a) and (b) has strong bonds between the polymer chains. Consequently, a surface layer including such a polyurethane resin as a binder resin is excellent in wear resistance, Young's modulus and break strength. Such a surface layer has small permanent compression set. Moreover, the lowest unoccupied molecular orbital (LUMO) which accepts electrons is concentrated in the ester groups, and hence, the property of the surface layer of imparting frictional charge to toner can be rendered suitable.

That is, when setting EcX to be 7.5% or more, the surface layer has sufficient mechanical properties, and permanent compression set can be inhibited from occurring. On the other hand, when setting EcX to be 10.0% or less, the property of the surface layer of imparting charge to toner can be inhibited from becoming excessive, and blotching on an electrophotographic image can be inhibited from occurring.

The ester group concentration EcZ at the middle point Z in the thickness direction of the surface layer is set to be in the range of $11.0\% \leqq EcZ \leqq 14.0\%$. The reason for this is that the balance between the mechanical properties of the surface layer and the property of the surface layer of imparting charge to toner can be achieved at a higher level.

Further, the ester group concentration EcY at the middle point between X and Z is set to be preferably in the range of $9.0\% \leqq EcY \leqq 13.0\%$. The reason for this is that such a range is effective in improving the mechanical properties of the surface layer and in suppressing the occurrence of permanent compression set.

The urethane group concentration (UrcX) is a value representing the ratio of the nitrogen element in the vicinity of the surface of the surface layer. When setting UrcX to be 0.5% or more, sufficient mechanical properties can be obtained even in a high-temperature high-humidity environment, and image defects, such as image streaks, at the portion in contact with the development bias can be inhibited from occurring. On the other hand, when setting UrcX to be 2.0% or less, excessive charge can be inhibited from being imparted to toner, and image defects, such as blotching, can be inhibited from occurring in a low-temperature low-humidity environment.

EcX, EcY, EcZ and UrcX are values measured by X-ray photoelectron spectroscopy, called ESCA (or XPS). ESCA is an analysis method which can identify an elemental composition and a chemical bond state in the vicinity (tens of mn in the depth direction) of the surface of the surface layer of the developing roller. Further, using fullerene ($C_{60}$) ions, ESCA is a method capable of quantifying chemical bond state distribution in the film thickness direction while precisely etching the surface layer. The definitions of EcX, EcY, EcZ and UrcX in the surface layer measured by ESCA (X-ray photoelectron spectroscopy) in the present invention will be described below in detail.

The presence of the structures represented by chemical formulas (a) and (b), the polybutadiene skeleton, and the polyisoprene skeleton in the polyurethane resin can be confirmed by infrared spectroscopy (IR), or by using pyrolysis gas chromatography (Pyr-GC) after hydrolyzing the resin material.

The surface layer according to the present invention includes carbon black (C). Carbon black (C) contributes to setting the mechanical properties and conductivity of the surface layer at an appropriate level. Methods which can be employed to improve the mechanical properties of the polyurethane resin include increasing crosslink density, or adding reinforcing filler such as carbon black. An increase in crosslink density results in an increase in the urethane group concentration. However, urethane groups have a lone electron pair on the nitrogen atom, and exhibit excellent negative charge imparting properties. Thus, if the urethane group concentration is increased too much, excessive charge imparting properties is exhibited in some cases. Therefore, in the present invention, from the perspective of setting the mechanical properties and the charge conferring properties at an appropriate level, carbon black needs to be included as an essential component. Accordingly, the polyurethane resin raw material mixture according to the present invention includes carbon black (C) in the range of 18 parts by mass or more and 30 parts by mass or less based on 100 parts by mass of the resin component of the polyurethane resin raw material mixture.

The content of the carbon black in the surface layer is required to be in the range of 18 to 30 parts by mass based on 100 parts by mass of the polyurethane resin component. By setting the carbon black content to 18 parts by mass or more, not only can suitable conductivity be obtained, but also the charge conferring properties can be set at an appropriate level and permanent compression set can be suppressed. On the other hand, it is desirable to set the carbon black content to be 30 parts by mass or less, because the dispersion uniformity of the carbon black in the polyurethane resin component can be obtained, and good resistance to leakage can be obtained.

The surface layer 4 may include spherical fine particles which form irregularities on the surface of the developing roller to impart suitable surface roughness on the surface. The inclusion of spherical fine particles in the surface layer 4 makes it easier to render the surface roughness of the surface layer of the developing roller uniform, and even when the surface layer 4 has been worn, enables variation in the surface roughness to be reduced and allows the surface state to be kept constant. The spherical fine particles may have a volume average particle size of 8 to 30 μm. Measurement of the volume particle size of the spherical fine particles can be carried out by using a laser diffraction particle size distribution analyzer (trade name: LS-230, manufactured by Beckman Coulter Inc.) provided with a liquid module. A slight amount of surfactant is added to about 10 cc of water, and thereto, about 10 mg of the fine particles is added and dispersed for 10 minutes by means of an ultrasonic dispersion machine, and then making a measurement under the condition that the number of measurement times is once and a measurement time is 90 seconds. The value obtained by such a measurement method can be used as the volume average particle size value. The content of the spherical fine particles is preferably 1 to 100 parts by mass based on 100 parts by mass of the resin of the surface layer 4.

Examples of the material for the spherical fine particles include urethane resin, polyester resin, polyether resin, acrylic resin, and polycarbonate resin. These spherical fine particles can be produced, for example, by suspension polymerization or by dispersion polymerization.

In addition to the above-described components, the above-described surface layer 4 may contain, as needed, various additives within a range in which functions of the above-described components are not impaired. Examples of such additives include filler, a bulking agent, a vulcanizing agent, a crosslinking agent, a vulcanizing aid, a crosslinking aid, an antioxidant, an antiaging agent, and a processing aid.

The thickness of the surface layer 4 is preferably 1 to 50 μm, and more preferably 3 to 25 μm. If the thickness of the surface layer 4 is 1 μm or more, precipitation of low molecular weight components contained in the layers beneath the surface layer 4 can be suppressed. Further, when the thickness is 1 μm or more, the ester group and urethane group concentrations in the present invention can be accurately measured by ESCA analysis. If the thickness of the surface layer 4 is 50 μm or less, the hardness of the developing roller can be prevented from becoming high, and toner melt adhesion can be prevented.

<Production Method of Surface Layer 4>

As described above, in the surface layer according to the present invention, it is necessary to appropriately control the ester group concentration near the surface, the ester group distribution in the thickness direction, and the urethane group concentration near the surface. The ester group concentration near the surface and the urethane group concentration near the surface of the surface layer strongly influence the charge imparting properties of the surface layer. Further, the concentration of ester groups in the thickness direction strongly influences the mechanical properties of the urethane resin in the surface layer. Therefore, in order to form such a surface layer, the selection of the polyol as the raw material is important.

The surface layer 4 having the above-described structure can be produced by forming on the periphery of the elastic layer 3 a coating film of a coating solution for surface layer formation which includes a polyurethane resin raw material mixture including the following (D1) or (D2), the following (E), carbon black and an isocyanate compound, and then curing this coating film.

(D1) is a polyester polyol which has a number average molecular weight (Mn) in the range of 1,200≦Mn≦2,000, and includes at least one of the units represented by the following chemical formulae (a) and (b).

(D2) is a polyester polyol which has a number average molecular weight (Mn) in the range of 4,000≦Mn≦8,000, and includes a urethane group and at least one of the units represented by the following chemical formulae (a) and (b).

(E) is a polyolefin polyol which has a number average molecular weight (Mn) in the range of 1,200≦Mn≦2,800, and includes at least one of a polybutadiene skeleton and a polyisoprene skeleton.

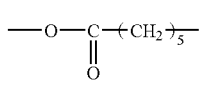

(a)

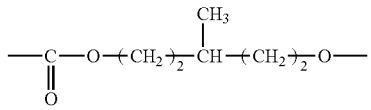

(b)

The (E) is less polar than the (D1) and (D2). Thus, the nearer to the coating film surface, the larger the mole ratio of the (E) to the (D1) or (D2). However, even though the (D1) or (D2) and the (E) are not completely compatible in the coating film, phase separation does not occur because the difference in their polarities is at an appropriate level. The surface layer obtained by curing such a coating film has a ratio of "the polyurethane resin associated with the reaction between the (E) and the isocyanate" to "the polyurethane resin associated with the reaction between the (D1) or (D2) and the isocyanate", which increases toward the surface in the thickness direction of the surface layer.

Where the mass contents of the (D1) or (D2) and the (E) in the above coating solution are defined as M(D) and M(E), respectively, the value of M(D)/M(E) is preferably 8.8 or more and 82.8 or less. When setting the value of M(D)/M(E) to be 8.8 or more, the values of EcY and EcZ in the resulting surface layer can reliably be inhibited from becoming small. Further, the (D1) or (D2) and the (E) can be reliably inhibited from being incompatible with each other. In addition, suppression of the permanent compression set of the surface layer and the setting of the toner frictional charging performance at an appropriate level can be achieved. Furthermore, carbon black can be inhibited from being insufficiently dispersed, and uniform charge imparting properties and appropriate conductivity can be obtained.

When setting the value of M(D)/M(E) to be 82.8 or less, the amount of the (E) component near the surface of the coating film can be set appropriately, and the performance of frictionally charging toner on the surface layer can be set at a much more appropriate level.

<<(D1), (D2)>>

The polyester polyol associated with the (D1) and (D2) includes at least one of the units represented by formulae (a) and (b). Polyester polyols obtained by a direct esterification reaction or by a ring-opening polymerization reaction may be used as this polyester polyol. Alternatively, a polyurethane polyol prepolymer obtained by chain extension of a polyester polyol and an isocyanate may also be suitably used.

Polyester polyols synthesized by a direct esterification reaction can be obtained by dehydration condensation of a polyprotic acid and a polyhydric alcohol as raw materials. Examples of the polyprotic acid include adipic acid, isophthalic acid, tetrachlorophthalic anhydride, HET acid, tetrabromophthalic anhydride, phthalic anhydride, isophthalic acid, terephthalic acid, tetrahydrophthalic anhydride, hexahydrophthalic anhydride, succinic acid, sebacic acid, fumaric acid, trimellitic acid, dimer acid, maleic anhydride, 1,12-dodecanedioic acid, 1,2-cyclohexanedicarboxylic acid, 1,3-cyclohexanedicarboxylic acid, 1,4-cyclohexanedicarboxylic acid, and 5-sodiosulfo isophthalic acid. Among these, adipic acid, isophthalic acid, terephthalic acid and sebacic acid are especially desirable, because these acids are easily available.

Examples of polyhydric alcohols as the raw material for a common ester polyol include 1,4-butanediol, 1,3-butanediol, 2,3-butanediol, ethylene glycol, diethylene glycol, dipropylene glycol, triethylene glycol, 1,5-pentanediol, 1,6-hexanediol, neopentyl glycol, bisphenol A, glycerin, pentaerythritol, trimethylolpropane, trimethylolethane, 1,4-cyclohexanedimethanol, 2,2,4-trimethyl-1,3-pentanediol, 2-butyl-2-ethyl-1,3-propanediol, hydroxypivalylhydroxypivalate, 3-methyl-1,5-pentanediol, 2-methyl-1,8-octanediol, 1,9-nonanediol, 2-methyl-1,3-propanediol, 2,4-diethyl-1,5-pentanediol and the like.

In the present invention, a polyester polyol whose raw material is 3-methyl-1,5-pentanediol is especially preferable. As compared with the melting point of typical polyhydric alcohols (−10° C. to 200° C.), 3-methyl-1,5-pentanediol exhibits a distinctly low melting point (−50° C.). Therefore, since the crystallinity degree in the soft segment having the ester group in the urethane resin can be easily controlled, 3-methyl-1,5-pentanediol contributes to the expression of mechanical properties due to improvement in compatibility with the (E) as described below in detail. Further, 3-methyl-1,5-pentanediol is especially desirable because it exhibits hydrophobicity due to the methyl group in its chemical structure, and thus has suitable compatibility with the (E).

The following are also especially preferable: polycaprolactone diol obtained by a ring-opening-polymerization reaction of s-caprolactone as a raw material, and a polyester polyol (prepolymer type ester polyol) synthesized by forming a prepolymer of polycaprolactone diol. Among such polycaprolactone diols, from the standpoint of compatibility with the (E), especially preferable ones are of types which are amorphous or have a low melting point.

The Mn of the (D1) is in the range of 1,200≦Mn≦2,000. When the Mn is 1,200 or more, the urethane group concentration (UrcX) of the surface layer can be effectively inhibited from increasing, and toner can be effectively inhibited from being excessively charged in a low-temperature low-humidity environment. In addition, when the Mn is 2,000 or less, the UrcX at the surface of the surface layer can be inhibited from excessively decreasing, and the permanent compression set of the surface layer can be inhibited from becoming large in a high-temperature high-humidity environment.

The Mn of the (D2) is in the range of 4,000≦Mn≦8,000.

<<(E)>>

The (E) is a polyolefin polyol including at least one of a polybutadiene skeleton or a polyisoprene skeleton. Specific examples of this polyolefin polyol include polybutadiene polyols, polyisoprene polyols, hydrogenated polybutadiene polyols, and hydrogenated polyisoprene polyols.

In order to appropriately adjust mechanical properties and polarity as required, prepolymers formed from the polyols also can be preferably used. Such prepolymers may be used each singly or in combination.

The number average molecular weight Mn of the (E) is in the range of 1,200≦Mn≦2,800. When the number average molecular weight is in this range, the (E) can be inhibited from becoming incompatible with the resin material (D1) or (D2). When the Mn is 1,200 or more, the urethane group concentration (UrcX) of the surface layer can be inhibited from decreasing, and toner can be inhibited from being excessively charged in a low-temperature low-humidity environment. When the Mn is 2,800 or less, the urethane group concentration can be inhibited from excessively decreasing, and the permanent compression set can be inhibited from increasing. In addition, sufficient surface orientation can be obtained.

<<Isocyanate>>

The isocyanate compound, which is a curing agent, is not specifically limited. Examples include, but are not limited to, diphenylmethane-4,4'-diisocyanate, 1,5-naphthalene diisocyanate, 3,3'-dimethylbiphenyl-4,-diisocyanate, 4,4'-dicyclohexylmethane diisocyanate, carbodiimide modified MDI, xylylene diisocyanate, trimethylhexamethylene diisocyanate, tolylene diisocyanate, naphthylene diisocyanate, a paraphenylene diisocyanate, hexamethylene diisocyanate, polymethylene polyphenyl polyisocyanate, copolymers thereof, and blocks and mixtures thereof.

Among the above examples, a prepolymer isocyanate including at least one of the units represented by the above chemical formulae (a) and (b) in the variable moiety (soft segment moiety) is especially preferable, due to its compatibility with the polyols and the ease of adjusting physical properties. As the raw material constituting the variable moiety including the unit represented by the above chemical formulae (a) and (b), the same materials as used for the above-described polyols may be used.

It is especially preferable to add the isocyanate compound so that the isocyanate index is in the range of 1.0 to 1.5 with respect to the polyol compound. When the isocyanate compound is added in this range, the permanent compression set can be inhibited from increasing due to unreacted polyols and the hardness can be inhibited from excessively increasing. The "isocyanate index" refers to the ratio ([NCO]/[OH]) between the number of moles of isocyanate groups in the isocyanate compound and the number of moles of hydroxyl groups in the polyol component.

In order to disperse carbon black in the coating solution, it is preferable to use oxidatively-treated carbon black provided with a surface functional group by oxidation treatment. The pH value of the oxidatively-treated carbon black is preferably 5.0 or less. Since the oxidatively-treated carbon black has a polar group on the surface, affinity with the resin component forming the surface layer is improved. Thus, the carbon black can be uniformly dispersed even if the carbon black is used in a range in which sufficient conductivity can be imparted. Further, agglomeration occurring over time can be suppressed, and image defects such as ghost and leakage can be inhibited from occurring. In order to maintain the strength of the developing roller surface layer and to express appropriate conductivity, the carbon black has preferably an average particle size of 15 to 40 nm. For the same reasons, the DBP oil absorption of the carbon black is preferably 60 to 180 ml/100 g. Examples of such carbon black include carbon black produced by a channel method or a furnace method. Further, in accordance with the required physical properties, two or more types of carbon blacks may be blended in combination.

Examples of solvents which may be used in the coating solution for surface layer formation including the (D1) or (D2) and the (E) include methyl ethyl ketone, toluene, and alcohols. Examples of methods which may be used for forming the coating film of the coating solution on the elastic layer include coating methods such as spraying, dipping, and roll coating. The surface layer can be formed by drying the coating film formed on the resin layer to remove the solvent, and then curing the coating film with the solvent removed therefrom. The curing may also be carried out by either heating or electron-beam irradiation.

Figure 2:
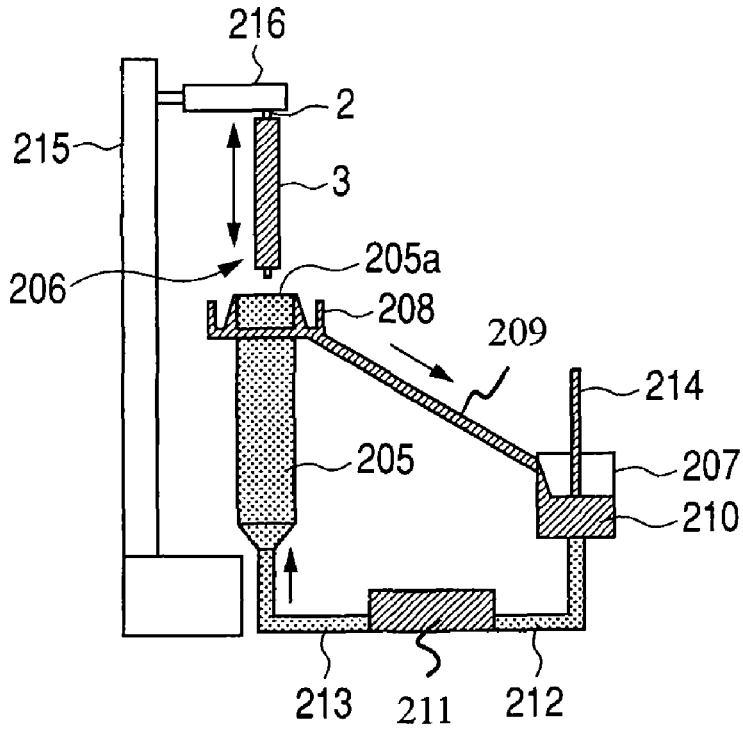
FIG. 2 is an explanatory diagram of a liquid-circulation type dip coating apparatus used for forming a surface layer.

When using dip coating for the coating film formation, it is preferable to use a coating apparatus having the circulation mechanism illustrated in the schematic configuration diagram of FIG. 2. The circulation mechanism illustrated in FIG. 2 has a dipping tank 205. The dipping tank 205 has an inner diameter slightly larger than the outer diameter of a roller 206 on which a resin layer 3 has been formed. The dipping tank 205 has a cylindrical shape with a longer depth in the axial direction than the roller 206. The dipping tank 205 is placed so that its axial direction is set to be in a perpendicular direction. A circular liquid receiving part 208 is provided on the outer periphery of the upper edge of the dipping tank 205. The liquid receiving part 208 is connected to a stirring tank 207 through a tube 209 which is connected to the bottom face of the liquid receiving part 208. A lower portion of the dipping tank 205 is connected to a pump 211 which circulates a coating solution 210 for surface layer formation via a tube 213. The pump 211 and the stirring tank 207 are connected through a connection tube 212. The stirring tank 207 is provided with a stirring blade 214 for stirring the coating solution 210 for surface layer formation which is held in the interior of the stirring tank 207. This coating apparatus is provided with a hoisting apparatus 215 for hoisting a hoist plate 216 in the axial direction of the dipping tank 205 at an upper portion of the dipping tank 205. The roller 206 suspended on the hoist plate 216 can be caused to enter into and retract from the dipping tank 205. In order to form the surface layer 4 on the resin layer 3 by using this coating apparatus, the pump 211 is driven to supply the coating solution 210 for surface layer formation contained in the stirring tank 207 to the dipping tank 205 via tubes 212 and 213. The hoist plate 216 is lowered by driving the hoisting apparatus 215, and the roller 206 is caused to enter into the dipping tank 205 which is filled with the coating solution 210 for surface layer formation. The coating solution 210 for surface layer formation which has flowed out from an upper edge 205*a* of the dipping tank because of the entrance of the roller 206 is received in the liquid receiving part 208, and returned to the stirring tank 207 via the tube 209. Subsequently, the hoist plate is raised by driving the hoisting apparatus, and the roller 206 is caused to retreat from the dipping tank 205 at a predetermined speed, thereby forming a coating film on the resin layer 3. The stirring blade 214 is rotated in the stirring tank 207 to stir the coating fluid and suppress sedimentation of the contents, whereby the uniformity of the coating fluid is maintained. The roller with the coating film formed thereon is taken out from the hoist plate 216, and the coating film is then dried and cured to form the surface layer 4.

<Mandrel 2>

The conductive mandrel 2 is not limited as long as it has the required strength for a developing roller, and conductivity for serving as an electrode which can transfer the charged toner to the photosensitive member. Examples of the material include metals such as aluminum, stainless steel and copper, and alloys thereof; iron plated with chromium, nickel and the like, and conductive synthetic resins.

<Resin Layer 3>

The thickness of the resin layer 3 is preferably 1 mm or more and 5 mm or less. The hardness of the resin layer 3 may be 20 or more and 80 or less in terms of Asker-C hardness. "Asker-C hardness" is measured using an Asker-C hardness spring type rubber hardness tester (manufactured by Koubunshi Keiki Co., Ltd.) according to The Society of Rubber Industry, Japan, standard SRIS101. In the present invention, the measurement value is obtained after pressing the above-described hardness tester at force of 10 N for 30 seconds against a developing roller which has been left standing for 12 hours in an ordinary-temperature ordinary-humidity (temperature of 23° C., humidity of 50% RH) environment.

The resin layer 3 may be a foam or non-foam body. Examples of materials of the resin layer 3 include ethylene-propylene-diene copolymer rubber (EPDM), acrylonitrile-butadiene rubber (NBR), chloroprene rubber (CR), natural rubber (NR), isoprene rubber (IR), epoxy rubber, urea rubber, melamine rubber, diallyl phthalate rubber, polycarbonate rubber, styrene-butadiene rubber (SBR), styrol rubber, fluoro-rubber, silicone rubber, epichlorohydrine rubber, a hydride of NBR, polysulfide rubber, and urethane rubber. These materials may be used each singly or in combination.

In order for the developing roller to have an electrical resistance in the semiconductor region, it is preferable that the resin layer 3 has conductivity. In order that the resin layer 3 has conductivity, it is preferable that the resin layer 3 contains a conduction imparting agent based on an ion conduction mechanism or an electron conduction mechanism. Examples of such a conduction imparting agent which can be used include fine particles of graphite, carbon black, a conductive metal such as aluminum or copper, and a conductive metal oxide such as zinc oxide, tin oxide, titanium oxide and the like. These may be used each singly or in combination. Among these examples, carbon black is comparatively easily available and can provide good charge properties, and thus carbon black is preferable. The resin layer 3 may have a volume resistance in the range of $1\times10^{3}$ to $1\times10^{11}$ Ω·cm. If the volume resistance is in the range of $1\times10^{3}$ to $1\times10^{11}$ Ω·cm, toner can be uniformly charged. A more preferable range of the volume resistance of the resin layer 3 is $1\times10^{3}$ to $1\times10^{8}$ Ω·cm.

Figure 3:
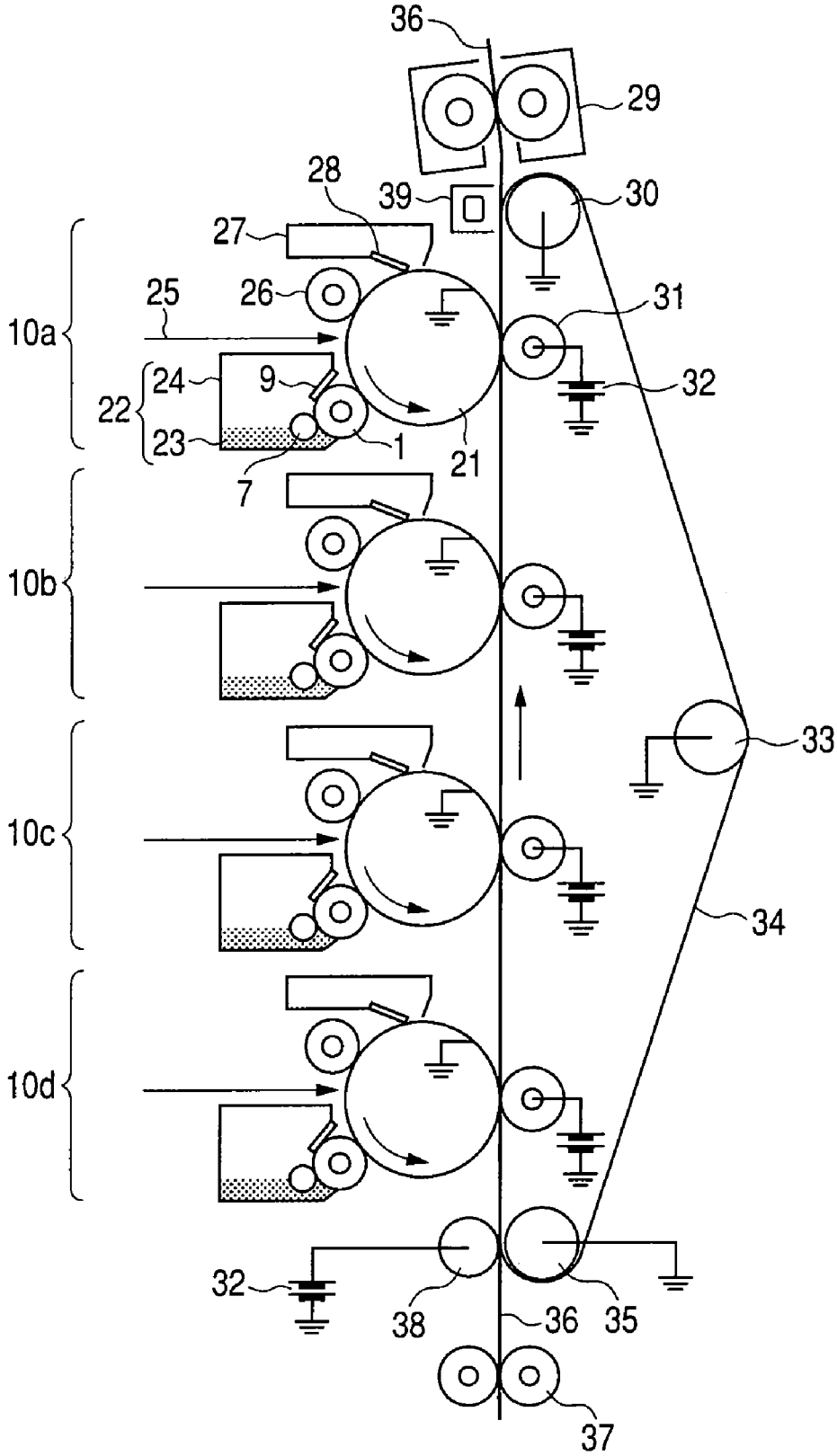
FIG. 3 is a cross-sectional view of an electrophotographic apparatus according to the present invention.
Figure 4:
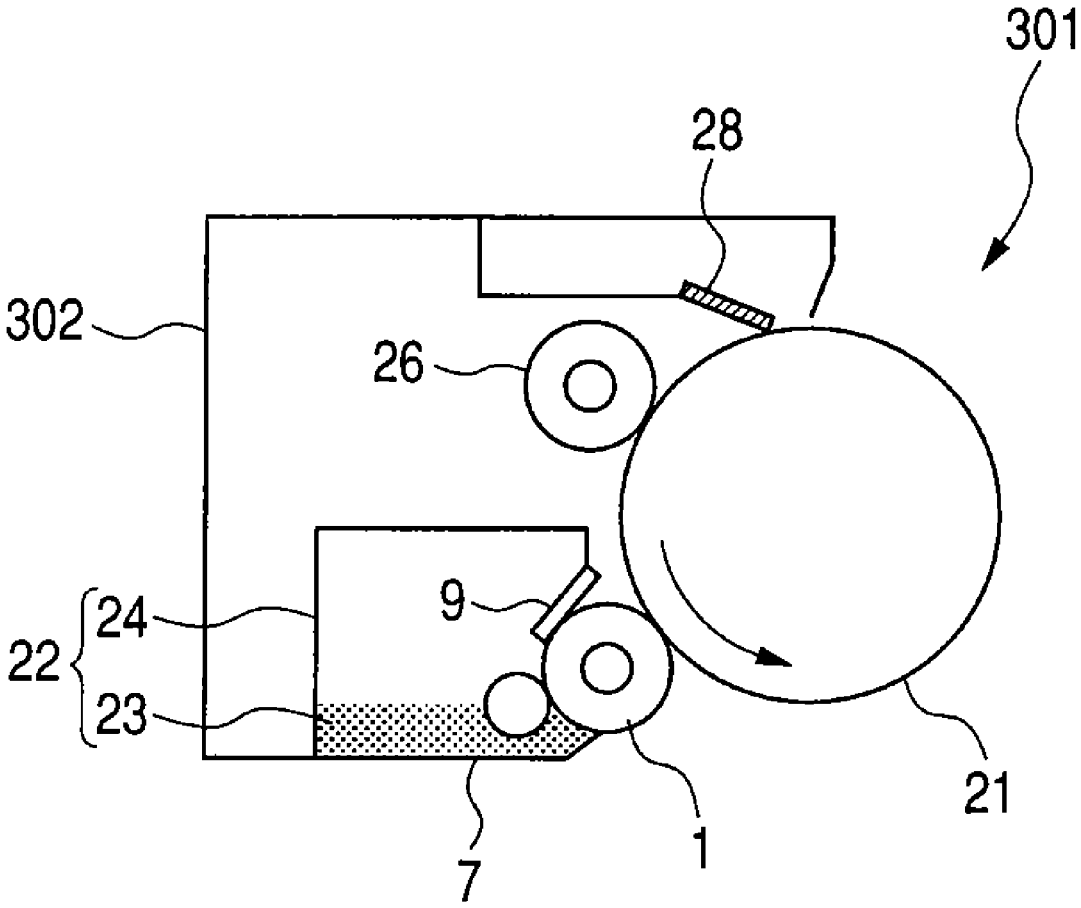
FIG. 4 is a cross-sectional view of a process cartridge according to the present invention.

FIGS. 3 and 4 respectively illustrate cross-sections of a color electrophotographic image forming apparatus and a process cartridge with the developing roller according to the present invention mounted thereon.

The color electrophotographic image forming apparatus illustrated in FIG. 3 has image forming units 10*a* to 10*d* in a tandem system provided for each of the color toners of yellow Y. magenta M, cyan C, and black BK. These image forming units 10*a* to 10*d* have substantially the same configuration. The image forming units 10*a* to 10*d* are provided with a photosensitive member 21 as a latent image bearing member which rotates in an arrow direction. The following are arranged on the periphery of the photosensitive member 21: a charging roller 26 for uniformly charging the photosensitive member 21, an exposure unit for forming an electrostatic latent image by irradiating the photosensitive member 21 uniformly charged with laser light 25, and a development apparatus 22 for supplying toner onto the photosensitive member 21 on which the electrostatic latent image is formed to develop the electrostatic latent image. Further, the following are arranged on the periphery of the photosensitive member 21: a transfer member having a transfer roller 31 for transferring the toner image on the photosensitive member 21 onto a recording medium 36 by applying a bias voltage from a bias power source 32 through the back face of a recording medium (transfer material) 36, such as a paper sheet, which is fed by a feeding roller 37 and conveyed by a conveyance belt 34. The conveyer belt 34 is fitted over and around a driving roller 30, a driven roller 35, and a tension roller 33. The conveyance belt 34 is controlled so as to convey the recording medium 36 while moving in synchronization with each image forming unit so that the toner image formed on each image forming unit is transferred and successively superimposed on the recording medium 36. The recording medium 36 is electrostatically attracted to the conveyance belt 34 and conveyed by the action of an adsorption roller 38 which is provided immediately before the recording medium 36 reaches the conveyance belt 34.

The photosensitive member 21 and the developing roller 1 are arranged in contact with each other at predetermined pressure. The photosensitive member 21 and the developing roller 1 rotate in the same direction at a contact location between the photosensitive member 21 and the developing roller 1. The developing roller 1 can be used in a mode in which the developing roller 1 is not in contact with the photosensitive member 21. In such a case, the developing roller 1 is placed near the photosensitive member 21.

The toner image superimposed and transferred onto the recording medium 36 is fixed by a fixing apparatus 29, and is then discharged from the electrophotographic image forming apparatus by a conveyance apparatus (not shown in the figure). The recording medium 36 can be peeled off from the conveyance belt 34 by the action of a peeling apparatus 39 and then sent to the fixing apparatus 29. The image forming units 10 are provided with a cleaning member having a cleaning blade 28 for removing toner which has not been transferred and remains on the photosensitive member 21, and a waste toner container 27 for accommodating toner which was scraped off from the photosensitive member. The cleaned photosensitive member 21 can form an image, and waits for subsequent image formation. Further, only the development apparatus 22, or the photosensitive member 21, charging roller 26, development apparatus 22, cleaning blade 28 and waste toner container 27 as a unit, may be formed into a removable process cartridge which is attachable to and detachable from the main body of an electrophotographic apparatus. The development apparatus 22 set in each of the image forming units 10*a* to 10*d* is provided with a toner container 24 containing a toner 23, and the developing roller 1 which is arranged so as to block an aperture of the toner container and to face the photosensitive member at a portion that is exposed from the toner container. The toner container 24 is internally provided with a roller-shaped toner coating member 7 coming in contact with the developing roller 1 to supply the toner on the developing roller 1, and a developing blade 9 for forming the toner supplied on the developing roller 1 into a thin film and performing frictional charging. As the developing blade 9, the following may be used: a member in which a rubber elastic member is fixed on a metal plate, a member having spring characteristics such as a thin plate made of SUS or phosphor bronze, or a member formed by superimposing a resin or rubber layer on its surface. The toner layer on the developing roller can be controlled by applying to the developing blade 9 a higher voltage than the voltage applied to the developing roller 1. For this purpose, it is preferable to use a thin plate made of SUS or phosphor bronze as the developing blade 9. A voltage is applied to both the developing roller 1 and the developing blade 9 from a bias power source (not shown in the figure). The voltage applied to the developing blade 9 is preferably 100 to 300 V larger in terms of the absolute value than the voltage applied to the developing roller 1. From the standpoint of removing the toner remaining on the developing roller 1, the following is preferable as the toner coating member 7: for example, a member provided with a foam sponge body or a polyurethane foam on the mandrel, or a fur brush structure in which fibers of rayon, polyamide, etc. are implanted in the mandrel. This toner coating member 7 may be arranged having a suitable contact width abutting with the developing roller 1. In addition, it is preferable that the toner coating member 7 rotates in the reverse direction to the developing roller 1 at the contact portion.

A process cartridge 301 according to the present invention illustrated in FIG. 4 is attachable to and detachable from the body of the above-described electrophotographic image forming apparatus. In the process cartridge 301, the developing roller 1 of the present invention, photosensitive member 21, toner coating member 7, developing blade 9, toner 23, toner container 24, charging roller 26 and cleaning blade 28 are integrally held by a frame 302.

EXAMPLES

In each of the following Examples and Comparative Examples, a method of producing a roller with a resin layer will be exemplified and specifically explained.

(Production of Mandrel with Resin Layer)

A mandrel with a resin layer to be used in the production of a developing roller in each of the Examples and the Comparative Examples was produced in the following manner.

A mandrel 8 mm in diameter made of stainless steel was prepared for a mandrel. A primer (trade name: DY35-051, manufactured by Dow Corning Toray Co., Ltd.) was applied on the periphery of this mandrel, which was then baked for 30 minutes at a temperature of 150° C. The thickness of the primer after the baking was 1 μm.

The following materials were mixed to prepare a base material A of a liquid silicone rubber having a vinyl group.

Dimethylpolysiloxane having a vinyl group at both ends and a weight average molecular weight (Mw) of 10,000: 50 Parts by mass, Dimethylpolysiloxane having a vinyl group at both ends and Mw of 2,000,000: 50 Parts by mass, Carbon black (trade name: Raven 860 Ultra, manufactured by Columbian Chemicals Company): 6 Parts by mass.

The following materials were mixed to prepare a base material B of a liquid silicone rubber having a SiH group and a vinyl group.

Dimethylpolysiloxane having a vinyl group at both ends and a weight average molecular weight (Mw) of 10,000: 50 Parts by mass, Dimethylpolysiloxane having a vinyl group at both ends and a Mw of 2,000,000: 50 Parts by mass, Carbon black (trade name: Raven 860 Ultra, manufactured by Columbian Chemicals Company): 6 Parts by mass, Curing catalyst (2 mass % isopropanol solution of chloroplatinic acid): 0.5 Parts by mass, Methylhydrogenpolysiloxane: 3 Parts by mass (amount in which SiH group content is 1.1 moles based on 1 mole of vinyl groups contained in the liquid silicone rubber base material A and the liquid silicone rubber base material B).

The base material A and base material B were mixed in a mass ratio of 1:1 to prepare an unvulcanized silicone rubber material.

The mandrel was then placed in a cylindrical mold, and the above unvulcanized silicone rubber material was injected into the inside (cavity) of the mold. Next, the mold was heated to vulcanize and cure the silicone rubber material for 15 minutes at 150° C., and the resultant product was then cooled and taken out of the mold. Thereafter, the product was heated at 180° C. for 1 hour to complete curing reaction, so that a resin layer composed of silicone rubber was formed on the periphery of the mandrel. The produced resin layer had a diameter of 16 mm.

<Synthesis Methods of Prepolymer Polyol and Prepolymer Isocyanate Compounds>

[Synthesis of Prepolymer Polyol 1 (Pre-P1)]

100 Parts by mass of an ester diol (made from adipic acid and 3-methyl-1,5-pentanediol; Mn=1,000) (trade name: P-1010, manufactured by Kuraray Co., Ltd.)

43 Parts by mass of an isocyanate compound (trade name: Millionate MT, manufactured by Nippon Polyurethane Industry Co., Ltd.)

The above components were mixed in stages in MEK solvent. The resultant mixture was reacted for 6 hours at 80° C. under a nitrogen atmosphere to produce the ester-modified Prepolymer Polyol 1 (Pre-P1) having a number average molecular weight Mn of 5,400.

[Synthesis of Prepolymer Polyol 2 (Pre-P2)]

100 Parts by mass of an ester diol (made from adipic acid and 3-methyl-1,5-pentanediol; Mn=500) (trade name: P-510, manufactured by Kuraray Co., Ltd.)

54 Parts by mass of an isocyanate compound (trade name: Millionate MT, manufactured by Nippon Polyurethane Industry Co., Ltd.)

The above components were mixed in stages in MEK solvent. The resultant mixture was reacted for 5 hours at 80° C. under a nitrogen atmosphere to produce the ester-modified Prepolymer Polyol 2 (Pre-P2) having a number average molecular weight Mn of 3,600.

[Synthesis of Prepolymer Polyol 3 (Pre-P3)]

100 Parts by mass of an ester diol (made from isophthalic acid and 3-methyl-1,5-pentanediol. Mn=500) (trade name: P-530, manufactured by Kuraray Co., Ltd.)

52 Parts by mass of an isocyanate compound (trade name: Millionate MT, manufactured by Nippon Polyurethane Industry Co., Ltd.)

The above components were mixed in stages in MEK solvent. The resultant mixture was reacted for 5 hours at 80° C. under a nitrogen atmosphere to produce the ester-modified Prepolymer Polyol 3 (Pre-P3) having a number average molecular weight Mn of 4,000.

[Synthesis of Prepolymer Polyol 4 (Pre-P4)]

100 Parts by mass of caprolactone diol (trade name: L-220AL, manufactured by Daicel Chemical Industries Ltd., Mn=1900)

32 Parts by mass of an isocyanate compound (trade name: Millionate MT, manufactured by Nippon Polyurethane Industry Co., Ltd.)

The above components were mixed in stages in MEK solvent. The resultant mixture was reacted for 8 hours at 80° C. under a nitrogen atmosphere to produce the ester-modified Prepolymer Polyol 4 (Pre-P4) having a number average molecular weight Mn of 8,000.

[Synthesis of Prepolymer Polyol 5 (Pre-P5)]

100 Parts by mass of an ester diol (made from adipic acid and 3-methyl-1,5-pentanediol. Mn=2000) (trade name: P-2010, manufactured by Kuraray Co., Ltd.)

31 Parts by mass of an isocyanate compound (trade name: Millionate MT, manufactured by Nippon Polyurethane Industry Co., Ltd.)

The above components were mixed in stages in MEK solvent. The resultant mixture was reacted for 8 hours at 80° C. under a nitrogen atmosphere to produce the ester-modified Prepolymer Polyol 5 (Pre-P5) having a number average molecular weight Mn of 8,200.

[Synthesis of Prepolymer Polyol 6 (Pre-P6)]

100 Parts by mass of an ester diol (made from adipic acid and 1,6-hexanediol. Mn=900) (trade name: ADEKA NEWACE YG-108, manufactured by ADEKA Corporation)

38 Parts by mass of an isocyanate compound (trade name: Millionate MT, manufactured by Nippon Polyurethane Industry Co., Ltd.)

The above components were mixed in stages in MEK solvent. The resultant mixture was reacted for 7 hours at 80° C. under a nitrogen atmosphere to produce the ester-modified Prepolymer Polyol 6 (Pre-P6) having a number average molecular weight Mn of 6,200.

[Synthesis of Prepolymer Polyol 7 (Pre-P7)]

100 Parts by mass of an ester diol (made from adipic acid and 1,4-butanediol. Mn=1000) (trade name: ADEKA NEWACE YG-108, manufactured by ADEKA Corporation)

33 Parts by mass of an isocyanate compound (trade name: Millionate MT, manufactured by Nippon Polyurethane Industry Co., Ltd.)

The above components were mixed in stages in MEK solvent. The resultant mixture was reacted for 6 hours at 80° C. under a nitrogen atmosphere to produce the ester-modified Prepolymer Polyol 7 (Pre-P7) having a number average molecular weight Mn of 5,000.

[Synthesis of Prepolymer Isocyanate 1 (Pre-BI1)]

100 Parts by mass of caprolactone diol (trade name: L-212AL, manufactured by Daicel Chemical Industries Ltd., Mn=1,200)

90 Parts by mass of polymethylene polyphenylene polyisocyanate (trade name: Cosmonate M-100, manufactured by Mitsui Chemicals Polyurethanes, Inc.)

Under a nitrogen atmosphere, the above components were heated and reacted for 2 hours at 90° C. Subsequently, butyl Cellosolve was added so that the solid content was set to be 70% by mass. Then, 28 parts by mass of MEK oxime was added dropwise under the condition that reaction temperature was 50° C., to thereby obtain the ester-modified Prepolymer Isocyante 1 (Pre-BI1).

[Synthesis of Prepolymer Isocyanate 2 (Pre-BI2)]

100 Parts by mass of an ester diol (made from adipic acid and 3-methyl-1,5-pentanediol. Mn=1000) (trade name: P-1010, manufactured by Kuraray Co., Ltd.)

140 Parts by mass of a polymethylene polyphenylene polyisocyanate (trade name: Cosmonate M-100, manufactured by Mitsui Chemicals Polyurethanes, Inc.)

Under a nitrogen atmosphere, the above components were heated and reacted for 2 hours at 90° C. Subsequently, butyl Cellosolve was added so that the solid content was set to be 70% by mass. Then, 36 parts by mass of MEK oxime was added dropwise under the condition that reaction temperature was 50° C., to thereby obtain the ester-modified Prepolymer Isocyante 2 (Pre-BI2).

[Synthesis of Prepolymer Isocyanate 3 (Pre-BI3)]

100 Parts by mass of caprolactone diol (trade name: L-212AL, manufactured by Daicel Chemical Industries Ltd., Mn=1,200)

124 Parts by mass of a polymethylene polyphenylene polyisocyanate (trade name: Cosmonate M-100, manufactured by Mitsui Chemicals Polyurethanes, Inc.)

Under a nitrogen atmosphere, the above components were heated and reacted for 2 hours at 90° C. Subsequently, butyl cellosolve was added so that the solid content was set to be 70% by mass. Then, 32 parts by mass of MEK oxime was added dropwise under the condition that reaction temperature was then reduced to 50° C., to obtain the ester-modified Prepolymer Isocyante 3 (Pre-BI3).

[Synthesis of Prepolymer Isocyanate 4 (Pre-BI4)]

100 Parts by mass of an ester diol (made from adipic acid and 3-methyl-1,5-pentanediol. Mn=1000) (trade name: P-1010, manufactured by Kuraray Co., Ltd.)

92 Parts by mass of a polymethylene polyphenylene polyisocyanate (trade name: Cosmonate M-100, manufactured by Mitsui Chemicals Polyurethanes, Inc.)

Under a nitrogen atmosphere, the above components were heated and reacted for 2 hours at 90° C. Subsequently, butyl cellosolve was added so that the solid content was set to be 70% by mass. Then, 27 parts by mass of MEK oxime was added dropwise under the condition that the reaction temperature was 50° C., to thereby obtain the ester-modified Prepolymer Isocyante 4 (Pre-BI4).

[Synthesis of Prepolymer Isocyanate 5 (Pre-BI5)]

100 Parts by mass of an ester diol (made from adipic acid and 1,6-hexanediol. Mn=900) (trade name: ADEKANEWACE YG-108, manufactured by ADEKA Corporation)

78 Parts by mass of a polymethylene polyphenylene polyisocyanate (trade name: Cosmonate M-200, manufactured by Mitsui Chemicals Polyurethanes, Inc.)

Under a nitrogen atmosphere, the above components were heated and reacted for 2 hours at 90° C. Subsequently, butyl Cellosolve was added so that the solid content was set to be 70% by mass. The reaction temperature was then reduced to 50° C., and 42 parts by mass of MEK oxime was added dropwise to obtain the ester-modified Prepolymer Isocyante 5 (Pre-BI5).

[Synthesis of Prepolymer Isocyanate 6 (Pre-BI6)]

100 Parts by mass of an ester diol (made from adipic acid and 1,4-butanediol. Mn=1000) (trade name: ADEKANEWACE YG-108, manufactured by ADEKA Corporation)

86 Parts by mass of a polymethylene polyphenylene polyisocyanate (trade name: Cosmonate M-200, manufactured by Mitsui Chemicals Polyurethanes, Inc.)

Under a nitrogen atmosphere, the above components were heated and reacted for 2 hours at 90° C. Subsequently, butyl Cellosolve was added so that the solid content was set to be 70% by mass. Then, and 36 parts by mass of MEK oxime was added dropwise under the condition that the reaction temperature was then reduced to 50° C., to thereby obtain the ester-modified Prepolymer Isocyante 6 (Pre-BI6).

Preparation of Coating Solution (1) for Surface Layer Formation

100 Parts by mass of Pre-P1 (Mn: 5,400)

10 Parts by mass of polybutadiene polyol (trade name: Poly-Bd R-45HT, manufactured by Idemitsu Petroleum Co., Ltd., Mn =2,800)

37.8 Parts by mass of Pre-BI1

All of the above synthesized Pre-BI1 to Pre-BI6 correspond to D2

The above-described materials were used as the resin components. 18 parts by mass of carbon black (trade name: X-15, manufactured by Asahi Carbon Co., Ltd.) and MEK were added to 100 parts by mass of a mixture of the above-described materials, and the resultant mixture was mixed and stirred for 1 hour. Thereto, MEK was further added so that the total solid content was 33% by mass, and was mixed and stirred for a further 1 hour. The resulting mixed solution was dispersed by means of a horizontal bead mill (trade name: NVM-03, manufactured by IMEX Corporation) for 3 minutes at a peripheral speed of 7 m/sec, a flow rate of 1 cc/min, and a dispersion temperature of 15° C. In this case, glass beads having a diameter S of 1.5 mm were used (trade name: DMB 503B, manufactured by Potters Ballotini Co., Ltd.). Next, as resin particles for roughness adjustment, 5 parts by mass of polyurethane resin particles (trade name: Art Pearl CF-600T, manufactured by Negami Chemical Industry Co., Ltd.) based on 100 parts by mass of the resin component solid content was added, and was dispersed further for 1 hour. This solution was then diluted with MEK so that the solid content was set to be 23% by mass. The solution was filtered through a 300 mesh screen to produce the coating solution (1) for surface layer formation.

Preparation of Coating Solution (2) for Surface Layer Formation

The coating solution (2) for surface layer formation was prepared in the same manner as in the coating solution (1) for surface layer formation, except that the 18 parts by mass of carbon black (trade name: X-15, manufactured by Asahi Carbon Co., Ltd.) was changed to 23 parts by mass.

Preparation of Coating Solution (3) for Surface Layer Formation

The coating solution (3) for surface layer formation was prepared in the same manner as in the coating solution (1) for surface layer formation, except that the 18 parts by mass of carbon black (trade name: X-15, manufactured by Asahi Carbon Co., Ltd.) was changed to 30 parts by mass.

Preparation of Coating Solution (4) for Surface Layer Formation

100 Parts by mass of caprolactone diol (trade name: Placcel L-212AL, manufactured by Daicel Chemical Industries Ltd., Mn=1,200)

12 Parts by mass of polybutadiene polyol (trade name: Poly-Bd R-45HT, manufactured by Idemitsu Petroleum Co., Ltd., Mn=2,800)

240.3 Parts by mass of Pre-BI2

The coating solution (4) for surface layer formation was prepared in the same manner as in the coating solution (2) for surface layer formation, except that the resin components were changed to the above-described materials.

Preparation of Coating Solution (5) for Surface Layer Formation

100 Parts by mass of caprolactone diol (trade name: Placcel L-212AL, manufactured by Daicel Chemical Industries Ltd., Mn=1,200)

4 Parts by mass of polybutadiene polyol (trade name: Poly-Bd R-45HT, manufactured by Idemitsu Petroleum Co., Ltd., Mn=2,800)

231.3 Parts by mass of Pre-BI2

The coating solution (5) for surface layer formation was prepared in the same manner as in the coating solution (2) for surface layer formation, except that the resin components were changed to the above-described materials.

Preparation of Coating Solution (6) for Surface Layer Formation

100 Parts by mass of caprolactone diol (trade name: Placcel L-212AL, manufactured by Daicel Chemical Industries Ltd., Mn=1,200)

5 Parts by mass of polybutadiene polyol (trade name: Poly-Bd R-45HT, manufactured by Idemitsu Petroleum Co., Ltd., Mn=2,800)

183.7 Parts by mass of Pre-BI3

The coating solution (6) for surface layer formation was prepared in the same manner as in the coating solution (2) for surface layer formation, except that the resin components were changed to the above-described materials and the carbon black was changed to "carbon black (trade name: X-55, manufactured by Asahi Carbon Co., Ltd.)".

Preparation of Coating Solution (7) for Surface Layer Formation

100 Parts by mass of caprolactone diol (trade name: Placcel L-212AL, manufactured by Daicel Chemical Industries Ltd., Mn=1,200)

15 Parts by mass of polybutadiene polyol (trade name: Poly-Bd R-45HT, manufactured by Idemitsu Petroleum Co., Ltd., Mn=2,800)

213.2 Parts by mass of Pre-BI3

The coating solution (7) for surface layer formation was prepared in the same manner as in the coating solution (6) for surface layer formation, except that the resin components were changed to the above-described materials.

Preparation of Coating Solution (8) for Surface Layer Formation

100 Parts by mass of caprolactone diol (trade name: Placcel L-212AL, manufactured by Daicel Chemical Industries Ltd., Mn=1,200)

3 Parts by mass of polybutadiene polyol (trade name: Poly-Bd R-15HT, manufactured by Idemitsu Petroleum Co., Ltd., Mn=1,200)

205.0 Parts by mass of Pre-BI3

The coating solution (8) for surface layer formation was prepared in the same manner as in the coating solution (6) for surface layer formation, except that the resin components were changed to the above-described material.

Preparation of Coating Solution (9) for Surface Layer Formation

100 Parts by mass of caprolactone diol (trade name: Placcel L-220AL, manufactured by Daicel Chemical Industries Ltd., Mn=1,900)

10 Parts by mass of polyisoprene polyol (trade name: Poly-ip, manufactured by Idemitsu Petroleum Co., Ltd., Mn=2,500)

135.4 Parts by mass of Pre-BI3

The coating solution (9) for surface layer formation was prepared in the same manner as in the coating solution (6) for surface layer formation, except that the resin components were changed to the above-described materials.

Preparation of Coating Solution (10) for Surface Layer Formation

100 Parts by mass of an ester diol (trade name: NS 2400, manufactured by ADEKA Corporation formed from adipic acid and 3-methyl-1,5-pentanediol. Mn=2,000)

10 Parts by mass of polyisoprene polyol (trade name: Poly-ip, manufactured by Idemitsu Petroleum Co., Ltd., Mn=2,500)

111.4 Parts by mass of Pre-BI3

The coating solution (10) for surface layer formation was prepared in the same manner as in the coating solution (2) for surface layer formation, except that the resin components were changed to the above-described materials.

Preparation of Coating Solution (11) for Surface Layer Formation

The coating solution (11) for surface layer formation was prepared in the same manner as in the coating solution (10) for surface layer formation, except that the solution was diluted with MEK so that the solid content was set to be 12% by mass.

Preparation of Coating Solution (12) for Surface Layer Formation

The coating solution (12) for surface layer formation was prepared in the same manner as in the coating solution (10) for surface layer formation, except that the solution was diluted with MEK so that the solid content was set to be 32 mass %.

Preparation of Coating Solution (13) for Surface Layer Formation

100 Parts by mass of caprolactone diol (trade name: Placcel L-205AL, manufactured by Daicel Chemical Industries Ltd., Mn=500)

10 Parts by mass of a polyisoprene polyol (trade name: Poly-ip, manufactured by Idemitsu Petroleum Co., Ltd., Mn=2,500)

560.2 Parts by mass of Pre-BI2

The coating solution (13) for surface layer formation was prepared in the same manner as the coating solution (2) for surface layer formation, except that the resin components were changed to the above-described materials.

Preparation of Coating Solution (14) for Surface Layer Formation

100 Parts by mass of Pre-P2 (Mn: 3600)

20 Parts by mass of hydrogenated polyisoprene polyol (trade name: TH-21, manufactured by Kuraray Co., Ltd., Mn=2,700)

76.1 Parts by mass of Pre-BI2

The coating solution (14) for surface layer formation was prepared in the same manner as in the coating solution (2) for surface layer formation, except that the resin components were changed to the above-described materials.

Preparation of Coating Solution (15) for Surface Layer Formation

100 Parts by mass of Pre-P3 (Mn: 4000)

5 Parts by mass of hydrogenated polyisoprene polyol (trade name: TH-21, manufactured by Kuraray Co., Ltd., Mn=2,700)

56.8 Parts by mass of Pre-BI2

The coating solution (15) for surface layer formation was prepared in the same manner as in the coating solution (2) for surface layer formation, except that the resin components were changed to the above-described materials.

Preparation of Coating Solution (16) for Surface Layer Formation

100 Parts by mass of Pre-P4 (Mn: 8000)

22 Parts by mass of polybutadiene polyol (trade name: Poly-Bd R-15HT, manufactured by Idemitsu Petroleum Co., Ltd., Mn=1,200)

78.6 Parts by mass of Pre-BI1

The coating solution (16) for surface layer formation was prepared in the same manner as in the coating solution (2) for surface layer formation, except that the resin components were changed to the above-described materials.

Preparation of Coating Solution (17) for Surface Layer Formation

100 Parts by mass of Pre-P4 (Mn: 8000)

5 Parts by mass of polybutadiene polyol (trade name: Poly-Bd R-15HT, manufactured by Idemitsu Petroleum Co., Ltd., Mn=1,200)

36.2 Parts by mass of Pre-BI1

The coating solution (17) for surface layer formation was prepared in the same manner as in the coating solution (2) for surface layer formation, except that the resin components were changed to the above-described materials.

Preparation of Coating Solution (18) for Surface Layer Formation

100 Parts by mass of Pre-P5 (Mn: 8200)

15 Parts by mass of polybutadiene polyol (trade name: NISSO-B3000, manufactured by Nippon Soda Co., Ltd., Mn=3,200)

26.4 Parts by mass of Pre-BI1

The coating solution (18) for surface layer formation was prepared in the same manner as in the coating solution (2) for surface layer formation, except that the resin components were changed to the above-described materials.

Preparation of Coating Solution (19) for Surface Layer Formation

100 Parts by mass of caprolactone diol (trade name: Placcel L-220AL, manufactured by Daicel Chemical Industries Ltd., Mn=1,900)

10 Parts by mass of polybutadiene polyol (trade name: NISSO-B1000, manufactured by Nippon Soda Co., Ltd., Mn=1,000)

151.8 Parts by mass of Pre-BI3

The coating solution (19) for surface layer formation was prepared in the same manner as in the coating solution (2) for surface layer formation, except that the resin components were changed to the above-described materials.

Preparation of Coating Solution (20) for Surface Layer Formation

The coating solution (20) for surface layer formation was prepared in the same manner as in the coating solution (1) for surface layer formation, except that the amount of carbon black was changed to 15 parts by mass.

Preparation of Coating Solution (21) for Surface Layer Formation

The coating solution (21) for surface layer formation was prepared in the same manner as in the coating solution (1) for surface layer formation, except that the amount of carbon black was changed to 32 parts by mass.

Preparation of Coating Solution (22) for Surface Layer Formation

100 Parts by mass of an ester diol (trade name: YG-108, manufactured by ADEKA Corporation, Mn=900)

15 Parts by mass of a polybutadiene polyol (trade name: NISSO-B1000, manufactured by Nippon Soda Co., Ltd., Mn=1,000)

311.7 Parts by mass of Pre-BI5

The coating solution (22) for surface layer formation was prepared in the same manner as in the coating solution (2) for surface layer formation, except that the resin components were changed to the above-described materials.

Preparation of Coating Solution (23) for Surface Layer Formation

100 Parts by mass of caprolactone diol (trade name: Placcel L-220AL, manufactured by Daicel Chemical Industries Ltd., Mn=1,900)

2. Parts by mass of a polybutadiene polyol (trade name: NISSO-B1000, manufactured by Nippon Soda Co., Ltd., Mn=1,000)

153.1 Parts by mass of Pre-BI6

The coating solution (23) for surface layer formation was prepared in the same manner as in the coating solution (2) for surface layer formation, except that the resin components were changed to the above-described materials.

Preparation of Coating Solution (24) for Surface Layer Formation

100 Parts by mass of Pre-P6 (Mn: 5600)

10 Parts by mass of polyisoprene polyol (trade name: Poly-ip, manufactured by Idemitsu Petroleum Co., Ltd., Mn=2,500)

51.6 Parts by mass of Pre-BI5

The coating solution (24) for surface layer formation was prepared in the same manner as in the coating solution (2) for surface layer formation, except that the resin components were changed to the above-described materials.

Preparation of Coating Solution (25) for Surface Layer Formation

100 Parts by mass of caprolactone diol (trade name: Placcel L-220AL, manufactured by Daicel Chemical Industries Ltd., Mn=1,900)

10 Parts by mass of a polyisoprene polyol (trade name: Poly-ip, manufactured by Idemitsu Petroleum Co., Ltd., Mn=2,500)

158.5 Parts by mass of Pre-BI6

The coating solution (25) for surface layer formation was prepared in the same manner as in the coating solution (2) for surface layer formation, except that the resin components were changed to the above-described materials.

Preparation of Coating Solution (26) for Surface Layer Formation

100 Parts by mass of Pre-P7 (Mn: 5000)

5 Parts by mass of polybutadiene polyol (trade name: Poly-Bd R-45HT, manufactured by Idemitsu Petroleum Co., Ltd., Mn=2,800)

47.9 Parts by mass of Pre-BI6

The coating solution (26) for surface layer formation was prepared in the same manner as the coating solution (2) for surface layer formation, except that the resin components were changed to the above-described materials.

Preparation of Coating Solution (27) for Surface Layer Formation

100 Parts by mass of Pre-P5 (Mn: 8200)

18.5 Parts by mass of a polybutadiene polyol (trade name: NISSO-B3000, manufactured by Nippon Soda Co., Ltd., Mn=3,200)

38.4 Parts by mass of Pre-BI2

The coating solution (27) for surface layer formation was prepared in the same manner as in the coating solution (2) for surface layer formation, except that the resin components were changed to the above-described materials.

Preparation of Coating Solution (28) for Surface Layer Formation

100 Parts by mass of caprolactone diol (trade name: Placcel L-205AL, manufactured by Daicel Chemical Industries Ltd., Mn=500)

2 Parts by mass of a polybutadiene polyol (trade name: NISSO-B1000, manufactured by Nippon Soda Co., Ltd., Mn=1,000)

431.7 Parts by mass of Pre-BI1

The coating solution (28) for surface layer formation was prepared in the same manner as in the coating solution (2) for surface layer formation, except that the resin components were changed to the above-described materials.

Preparation of Coating Solution (29) for Surface Layer Formation

100 Parts by mass of caprolactone diol (trade name: Placcel L-220AL, manufactured by Daicel Chemical Industries Ltd., Mn=1,900)

10 Parts by mass of a polypropylene polyol (trade name: EXCENOL 3020, manufactured by Asahi Glass Co., Ltd., Mn=3,200)

154.2 Parts by mass of Pre-BI2

The coating solution (29) for surface layer formation was prepared in the same manner as in the coating solution (2) for surface layer formation, except that the resin components were changed to the above-described materials.

The compositions of the coating solutions (1) to (29) for surface layer formation are collectively shown in the following Tables 1-1 to 1-5.

TABLE 1-1

| Coating solution for surface layer formation | | 1 | 2 | 3 | 4 | 5 | 6 | 7 | 8 |
|---|---|---|---|---|---|---|---|---|---|
| (D1) Polyol | Trade name or number | | — | | | | Placcel L212AL | | |
| | Mn | | — | | | | 1200 | | |
| (D2) Polyol | Trade name or number | | Pre-P1 | | | | — | | |
| | Mn | | 5400 | | | | — | | |
| (E) Polyol | Trade name or number | | | Poly-Bd R-45HT | | | | | Poly-Bd R-15HT |
| | Olefin skeleton | | | | Butadiene | | | | |
| | Mn | | | 2800 | | | | | 1200 |
| M(D)/M(E) | | | 13.8 | | 28.4 | 82.8 | 56.7 | 20.9 | 102 |
| (D2) Isocyanate | Trade name or number | | Pre-BI1 | | Pre-BI2 | | | Pre-BI3 | |
| Ester structure included in polyurethane | | | (a) and (b) | | (a) and (b) | | | (a) | |
| Carbon black | Trade name or number | | | X-15 | | | | X-55 | |
| | Content | 18 parts | 23 parts | 30 parts | | | 23 parts | | |

TABLE 1-2

| Coating solution for surface layer formation | | 9 | 10 | 11 | 12 | 13 | 14 | 15 |
|---|---|---|---|---|---|---|---|---|
| (D1) Polyol | Trade name or number | Placcel L220AL | NS2400 | | | Placcel L205AL | — | |
| | Mn | 1900 | 2000 | | | 500 | — | |
| (D2) Polyol | Trade name or number | — | | | — | | Pre-P2 | Pre-P3 |
| | Mn | — | | | — | | 3600 | 4000 |
| (E) Polyol | Trade name or number | Poly-ip | | | Poly-ip | | TH-21 | |
| | Olefin skeleton | Isoprene | | | Isoprene | | Hydrogenated isoprene | |
| | Mn | 2500 | | | 2500 | | 2700 | |
| M(D)/M(E) | | 23.5 | | 21.1 | | 66.0 | 8.8 | 31.4 |
| (D2) Isocyanate | Trade name or number | Pre-BI3 | | Pre-BI3 | | | Pre-BI2 | |
| Ester structure included in polyurethane | | (a) | | | (a) and (b) | | (b) | |
| Carbon black | Trade name or number | X-55 | | | | X-15 | | |
| | Content | 23 parts | | | | 23 parts | | |

TABLE 1-3

| Coating solution for surface layer formation | | 16 | 17 | 18 | 19 |
|---|---|---|---|---|---|
| (D1) Polyol | Trade name or number | | — | | Placcel L220AL |
| | Mn | | — | | 1900 |
| (D2) Polyol | Trade name or number | Pre-P4 | | Pre-P5 | — |
| | Mn | 8000 | | 8200 | — |
| (E) Polyol | Trade name or number | Poly-Bd R-15HT | | NISSO-B3000 | NISSO-B1000 |
| | Olefin skeleton | | | Butadiene | |

TABLE 1-3-continued

| Coating solution for surface layer formation | | 16 | 17 | 18 | 19 |
|---|---|---|---|---|---|
| | Mn | 1200 | | 3200 | 1000 |
| M(D)/M(E) | | 8.2 | 27.2 | 8.4 | 25.2 |
| (D2) Isocyanate | Trade name or number | Pre-BI1 | | Pre-BI1 | Pre-BI3 |
| Ester structure included in polyurethane | | (a) | | (a) and (b) | (a) |
| Carbon black | Trade name or number | | | X-15 | |
| | Conent | | | 23 parts | |

TABLE 1-4

| Coating solution for surface layer formation | | 20 | 21 | 22 | 23 | 24 |
|---|---|---|---|---|---|---|
| (D1) Polyol | Trade name or number | — | | YG-108 | Placcel L-220AL | — |
| | Mn | — | | 900 | 1900 | — |
| (D2) Polyol | Trade name or number | Pre-P1 | | | — | Pre-P6 |
| | Mn | 5400 | | | — | 6200 |
| (E) Polyol | Trade name or number | Poly-Bd R-45HT | | NISSO-B1000 | | Poly-ip |
| | Olefin skeleton | | | Butadiene | | Isoprene |
| | Mn | 2800 | | 1000 | | 2500 |
| M(D)/M(E) | | 13.8 | | — | 126.6 | — |
| (D2) Isocyanate | Trade name or number | Pre-BI1 | | Pre-BI5 | Pre-BI6 | Pre-BI5 |
| Ester structure included in polyurethane | | (a) and (b) | | — | (a) and 1,4-BD | — |
| | | | | 1,6-HD | | 1,6-HD |
| Carbon black | Trade name or number | | | X-15 | | X-15 |
| | Content | 15 parts | 32 parts | 23 parts | | 23 parts |

TABLE 1-5

| Coating solution for surface layer formation | | 25 | 26 | 27 | 28 | 29 |
|---|---|---|---|---|---|---|
| (D1) Polyol | Trade name or number | Placcel L-220AL | | — | Placcel L205AL | Placcel L-220AL |
| | Mn | 1900 | | — | 500 | 1900 |
| (D2) Polyol | Trade name or number | — | Pre-P7 | Pre-P5 | — | — |
| | Mn | — | 5000 | 8200 | — | — |
| (E) Polyol | Trade name or number | Poly-ip | Poly-Bd R-45HT | NISSO-B3000 | NISSO-B1000 | EXCENOL 3020 |
| | Olefin skeleton | Isoprene | | Butadiene | | — |
| | Mn | 2500 | 2800 | 3200 | 1000 | 3200 |
| M(D)/M(E) | | 25.9 | — | 7.5 | 265.9 | — |
| (D2) Isocyanate | Trade name or number | Pre-BI6 | | Pre-BI2 | Pre-BI1 | Pre-BI2 |
| Ester structure included in polyurethane | | (a) | — | (b) | (a) | (a) and (b) |
| | | | 1,4-BD | | | |
| Carbon black | Trade name or number | | | X-15 | | |
| | Content | | | 23 parts | | |

Example 1

The coating solution (1) for surface layer formation, which was kept at a liquid temperature of 23° C., was poured into a cylinder with an inner diameter of 32 mm and a length of 300 mm from its bottom at a rate of 250 cc per minute. Coating solution which flowed out from the upper end of the cylinder was re-circulated into the cylinder from the bottom. The produced mandrel with a resin layer formed thereon was dipped in the cylinder at a dipping rate of 100 mm/s, was then stopped for 10 seconds, and thereafter drawn up at an initial rate of 300 mm/s and a final rate of 200 mm/s, followed by natural drying for 60 minutes. Next, the coating film formed on the periphery of the resin layer was subjected to heat treatment at 140° C. for 2 hours and was cured, to produce the developing roller (1) in Example 1 having a surface layer with a thickness of 10 μm.

Example 2 to Example 10

The developing roller in each of the Examples was produced in the same manner as in Example 1, except that the coating solutions (2) to (10) for surface layer formation were used instead of the coating solution (1) for surface layer formation. The results are shown in Table 2.

Example 11

The developing roller (11) in Example 11 having a 3 μm-thick resin layer was produced in the same manner as in Example 1, except that the coating solution (11) for surface layer formation was used instead of the coating solution (1) for surface layer formation. The results are shown in Table 2.

Example 12

The developing roller (12) in Example 12 having a 25 μm-thick resin layer was produced in the same manner as in Example 1, except that the coating solution (12) for surface layer formation was used instead of the coating solution (1) for surface layer formation. The results are shown in Table 2.

Example 13 to Example 19

The developing roller in each of the Examples was produced in the same manner as in Example 1, except that the coating solutions (13) to (19) for surface layer formation were used instead of the coating solution (1) for surface layer formation. The results are shown in Table 2.

Comparative Example 1 to Comparative Example 10

The developing roller in each of the Comparative Examples was produced in the same manner as in Example 1, except that the coating solutions (20) to (29) for surface layer formation were used instead of the coating solution (1) for surface layer formation. The results are shown in Table 3.

Next, the ESCA analysis, the structural analysis, the surface layer film thickness measurement and the GPC measurement method in the Examples and the Comparative Examples of the present invention will be described. Further, EcX, EcY, EcZ, and UrcX defined in the present invention will also be described.

[Developing Roller Evaluation/Surface Layer Raw Material Evaluation](ESCA Analysis Method)

The ESCA analysis was carried out under the following conditions using the Quantum 2000 available from ULVAC-PHI, Inc.

X-Ray Source: Monochrome Al Kα

X-Ray Setting: 100 μm ϕ (25 W (15 KV)

Photoelectron Takeoff Angle: 45 Degrees

Neutralization Conditions: Simultaneous use of a flood gun and an ion gun

Analysis region: ϕ100 μm

Pass Energy: 23.5 eV

Step Size: 0.1 eV

EcX, EcY, EcZ and UrcX were determined from the atom % of the elements carbon (C), nitrogen (N), oxygen (O), and silicon (S) originating from the resin layer, which were detected by quantitative analysis of the ESCA analysis, and from the surface area ratio between the C 1s peak and the N 1s peak detected by state analysis. Further, in the C 1s peak, the detected peak at 285.0 eV was ascribed to the C—C bond, the detected peak at 286.6 eV was ascribed to the C—O bond, and the detected peak at 289.3 eV was ascribed to the COO bond. In the N 1s peak, the detected peak at 400.4 eV was ascribed to the NH bond. In the O 1s peak, the detected peak at 532.4 eV was ascribed to the Si—O bond, and the detected peak at 533.7 eV was ascribed to the C—O bond. In the Si 2p peak, the peak intensity at 102.5 eV was ascribed to the Si—O bond.

As for the urethane group concentration in the polyurethane resin, since the amount of nitrogen (N) in the cured polyurethane resin was derived from the urethane groups, the nitrogen atom% value near the upper most surface was defined as UrcX. While the peak intensity at 289.3 eV in the state analysis of the C 1s peak was ascribed to the COO bond, that COO bond (hereinafter, referred to as "total COO bonds") is measured as the sum of the COO bonds derived from ester groups and the COO bonds derived from the urethane groups. The ratio between the number of NH bonds and the number of COO bonds of the urethane groups is 1:1, and hence, in the present invention, a value obtained by subtracting the NH bonds from the total COO bonds was taken as the COO bonds derived from ester groups, and the ester group concentration in the present invention was defined according to the following formula.

Ester group concentration={[COO bond percentage (%)]−[NH bond percentage (%)]}/[C—C bond percentage (%)]×100

Further, each of the EcX, EcY, EcZ and UrcX measurements in the present invention was carried out at three different locations for each of the X, Y and Z, and the arithmetic mean of the resulting values was employed. Here, the quantitative analysis of each of the elements was carried out using each of the C is (B.E. 280 to 295 eV), N 1s (B.E. 395 to 410 eV), and O 1s (B.E. 525 to 540 eV) peaks to determine the respective atom %.

For example, based on the results of the quantitative analysis of the elements in the surface layer upper most surface (X) of the developing roller (1), the C, N, O, and Si atom % were respectively 70.8%, 1.4%, 20.9%, and 6.9%, with the result that UrcX is 1.4. In addition, the peak surface area ratios of the C—O bond (derived from the urethane groups and the ester groups), C—C bond and COO bond of the C is spectrum based on the state analysis of the developing roller (1) were respectively 10.9%, 80.9%, and 8.2%. From these values, the ratios of the C—C bond and the COO bond at the surface layer upper most surface (X) of the developing roller (1) were respectively 57.2% (0.708×0.809×100) and 5.8% (0.708×0.082×100). Based on these values and the UrcX, the EcX of the developing roller (1) was calculated and found to be 8.7%.

Further, the EcY and EcZ values were evaluated after etching the surface layer under the following conditions.

Sputtering Ion: $C_{60}$ ion

Sputtering accelerating voltage: 4 kV

Raster size: 2×0.5 $mm^2$

EcY and EcZ were measured in the same manner as in EcX. As a result, EcY and EcZ were found to be 9.9% and 12.5%, respectively. The results for the developing rollers produced in the Examples and Comparative Examples are shown in Tables 1 to 3.

(Surface Layer Structure Analysis)

The structures of the surface layers of the obtained developing rollers were determined by pyrolysis GC-MS and $^1$H-NMR analysis. First, the surface layers of the developing rollers were thinly cut with a bio cutter and collected. Then, the collected material was subjected to alkaline hydrolysis with sodium hydroxide. Subsequently, thermolysis was further carried out in a pressure-resistant decomposition vessel and was separated into a polyol, a diacid, and an isocyanate. Next, the material thus separated was evaluated by pyrolysis GC-MS and $^1$H-NMR, and as a result, it was confirmed that the segments of chemical formulae (a) and (b) were intermingled, and that the surface layer had a butadiene skeleton. The results for the developing rollers produced in the Examples and Comparative Examples are shown in Tables 1 to 3.

(Method for Measuring Surface Layer Film Thickness)

The film thickness of the surface layer can be measured by cutting the developing roller and observing the cross section. More specifically, after making the image evaluation as described later, toner on the developing roller is wiped off with a cloth impregnated with methanol. The development is cut with a razor at positions 5 mm apart from both ends and the center portion in the longitudinal direction until the mandrel, to thereby prepare measurement samples with a size 1 mm in thickness. A cross section of these measurement samples is observed with a digital microscope (VH-2450, manufactured by Keyence Corporation). Measurement is made for each of the measurement samples by the above method at three points different in the peripheral direction of the developing roller. The arithmetic mean of the values measured at the nine points is defined as the film thickness of the developing roller surface layer. The results for the developing rollers produced in the Examples and Comparative Examples are shown in Tables 1 to 3.

(Number Average Molecular Weight of Polyol)

A high performance liquid chromatography analyzer "HLC-8120GPC" (trade name, manufactured by Tosoh Corporation) was used in which two "TSK gel Super IBM-M" (trade name, manufactured by Tosoh Corporation) GPC columns were serially connected. By using tetrahydrofuran (THF) as an elute, and a refractive index detector, 0.1 mass % solution in TBF as a measurement sample was measured under the conditions of a temperature of 40° C., and a flow rate of 0.6 mL/min. A calibration curve was prepared using several types of monodisperse standard polystyrenes (manufactured by Tosoh Corporation) as standard samples. The number average molecular weight (Mn) was determined from the holding times of the measurement samples obtained on the basis of this calibration curve. The results for the developing rollers produced in the Examples and Comparative Examples are shown in Tables 2-1 to 2-3.

[Image Evaluation]

[Blotching in Low-Temperature Low-Humidity Environment]

A developing roller was set in a modified electrophotographic process cartridge EP-85K (trade name, manufactured by Canon Inc., Color: Black, using a 100 μm-thick phosphor-bronze blade as the development blade). This electrophotographic process cartridge was left standing for 3 days in an environment with a temperature of 10° C. and a humidity of 10% RH. Subsequently, in the same environment, the electrophotographic process cartridge was mounted on a modified printer LBP5500 (trade name, manufactured by Canon Inc., modified so that a blade bias could be applied on the development blade and full color printing could be carried out at 40 rpm). Ten halftone images were output under the bias condition that the blade bias applied for the development blade bias is −200 V with respect to the development bias applied to the developing roller. The blotching levels of these halftone images in a low-temperature low-humidity environment were evaluated according to the following evaluation criteria. The results for the developing rollers produced in the Examples and Comparative Examples are shown in Tables 2-1 to 2-3.

A: No blotching is observed on images on the first to tenth sheets.

B: Slight blotching is observed on images on the first to fifth sheets, but no problem for practical use.

C: Blotching is observed on images on the first to tenth sheets, but no problem for photographic images.

D: Blotching is observed even after images are output on 10 or more sheets.

[Blade Bias Leak]

After making an evaluation on blotching, in the same environment, one halftone image was output while applying a blade bias at intervals of 100 V in the range of 0 V to −400 V for the development bias. The leak resistance of the developing roller with respect to the blade bias was evaluated for this halftone image according to the following evaluation criteria. The results for the developing rollers produced in the Examples and Comparative Examples are shown in Tables 1 to 3.

A: No black transverse streaks are observed even when images are output while applying a −400 V blade bias with respect to the development bias.

B: No black transverse streaks are observed even when images are output while applying a −300 V blade bias with respect to the development bias. However, black transverse streaks are found when image are output while applying a −400 V blade bias with respect to the development bias.

C: No black transverse streaks are observed even when images are output while applying a −200 V blade bias with respect to the development bias. However, black transverse streaks are observed when images are output while applying a −300 V blade bias with respect to the development bias.

D: Black transverse streaks are observed when images are output while applying a −100 V blade bias with respect to the development bias.

[Evaluation of Image Streaks Caused by Development Blade Contacted for Long Time in High-Temperature High-Humidity Environment]

A developing roller was set in a modified electrophotographic process cartridge EP-85K (trade name, manufactured by Canon Inc., Color: Black, using a 100 μm-thick phosphor-bronze blade as the development blade). This electrophotographic process cartridge was left standing for 20 days in an environment with a temperature of 40° C. and a humidity of 95% RH. The electrophotographic process cartridge was then left standing for 24 hours in an environment with a temperature of 30° C. and a humidity of 85% RH. Subsequently, in the same environment, the electrophotographic process cartridge was mounted on a modified printer LBP5500 (trade name, manufactured by Canon Inc., modified so that a blade bias could be applied to the development blade and full color printing could be carried out at 40 rpm). Three solid black images were output at a blade bias set to −150 V with respect to the development bias. Image streaks due to the deformation of the surface layer of the developing roller left standing in contact with the development blade were evaluated according to the following evaluation criteria. The results for the developing rollers produced in the Examples and Comparative Examples are shown in Tables 2-1 to 2-3.

A: Almost no image streak due to the deformation of the surface layer is observed on the solid black image.

B: Slight image streaks due to the deformation of the surface layer are observed in the solid black image.

C: Image streaks due to the deformation of the surface layer are clearly observed on the solid black image. However, no image streak is observed when the cartridge has been left standing for 24 hours in an ordinary temperature and humidity environment (temperature of 23° C., humidity of 50% RH), and then the solid black image is formed again.

D: Image streaks due to the deformation of the surface layer are clearly observed on the solid black image. In addition, image streaks are observed even when the cartridge was left standing for 24 hours in an ordinary temperature and humidity environment (temperature of 23° C., humidity of 50% RH), and then the solid black image is formed again.

TABLE 2-1

| | | Example No. | | | | | | | | |
|---|---|---|---|---|---|---|---|---|---|---|
| | | 1 | 2 | 3 | 4 | 5 | 6 | 7 | 8 | 9 |
| Coating solution No. for surface layer formation | | (1) | (2) | (3) | (4) | (5) | (6) | (7) | (8) | (9) |
| Surface layer film thickness (μm) | | 10 | | | | | | | | |
| ESCA measurement | EcX | 8.7 | 8.2 | 7.9 | 7.5 | 7.5 | 9.7 | 7.5 | 7.5 | 9.1 |
| | EcY | 9.9 | 10.4 | 9.2 | 9.0 | 10.9 | 12.0 | 8.0 | 13.0 | 11.8 |
| | EcZ | 12.5 | 12.3 | 11.6 | 11.0 | 11.0 | 13.6 | 14.0 | 14.0 | 13.1 |
| | UrcX | 1.4 | 1.3 | 1.1 | 0.7 | 1.8 | 2.0 | 0.9 | 1.9 | 1.2 |
| Evaluation results | Blotching in low-temperature low-humidity | A | A | A | A | B | C | A | C | A |
| | Leak resistance | A | A | C | C | B | A | B | B | A |
| | Image streak in high-temperature high-humidity | C | B | A | C | C | A | B | A | A |

TABLE 2-2

| | | Example No. | | | | | | | | | |
|---|---|---|---|---|---|---|---|---|---|---|---|
| | | 10 | 11 | 12 | 13 | 14 | 15 | 16 | 17 | 18 | 19 |
| Coating solution No. for surface layer formation | | (10) | (11) | (12) | (13) | (14) | (15) | (16) | (17) | (18) | (19) |
| Surface layer film thickness (μm) | | 10 | 3 | 25 | | | | 10 | | | |
| ESCA measurement | EcX | 8.8 | 8.6 | 9.4 | 9.2 | 10.0 | 10.0 | 10.0 | 10.0 | 7.9 | 8.4 |
| | EcY | 10.9 | 9.8 | 11.6 | 11.9 | 10.1 | 10.9 | 10.1 | 13.0 | 8.4 | 9.5 |
| | EcZ | 12.7 | 11.9 | 12.8 | 13.8 | 11.0 | 11.0 | 14.0 | 14.0 | 11.4 | 12.9 |
| | UrcX | 1.5 | 1.3 | 1.5 | 1.8 | 1.3 | 0.8 | 0.6 | 0.7 | 0.5 | 1.9 |
| Evaluation results | Blotching in low-temperature low-humidity | A | A | A | C | B | A | A | A | A | C |
| | Leak resistance | A | A | A | B | A | B | B | C | C | B |
| | Image streak in high-temperature high-humidity | A | B | A | A | B | C | C | B | C | A |

TABLE 2-3

| | | Comparative Example No. | | | | | | | | | |
|---|---|---|---|---|---|---|---|---|---|---|---|
| | | 1 | 2 | 3 | 4 | 5 | 6 | 7 | 8 | 9 | 10 |
| Coating solution No. for surface layer formation | | (20) | (21) | (22) | (23) | (24) | (25) | (26) | (27) | (28) | (29) |
| Surface layer film thickness (μm) | | 10 | | | | | | | | | |
| ESCA measurement | EcX | 8.6 | 7.7 | 7.4 | 10.4 | 7.8 | 8.9 | 9.4 | 7.6 | 9.8 | 9.5 |
| | EcY | 9.9 | 9.1 | 9.5 | 13.1 | 8.5 | 9.9 | 8.7 | 8.1 | 11.2 | 9.6 |
| | EcZ | 12.5 | 11.1 | 12.9 | 13.8 | 10.6 | 14.1 | 9.3 | 11.2 | 13.9 | 9.2 |
| | UrcX | 1.4 | 0.9 | 1.7 | 2.0 | 0.5 | 0.9 | 0.7 | 0.3 | 2.1 | 0.7 |
| Evaluation results | Blotching in low-temperature low-humidity | C | A | A | D | A | B | A | A | D | A |
| | Leak resistance | A | D | D | D | C | D | D | B | B | D |

TABLE 2-3-continued

| | Comparative Example No. | | | | | | | | | |
|---|---|---|---|---|---|---|---|---|---|---|
| | 1 | 2 | 3 | 4 | 5 | 6 | 7 | 8 | 9 | 10 |
| Image streak in high-temperature high-humidity | D | C | C | A | D | C | D | D | A | D |

As shown in Tables 2-1 and 2-2, the surface layers of the developing rollers produced in Examples 1 to 19 had in combination excellent mechanical properties and suitable performance of imparting charge to toner, and high-quality electrophotographic images were formed. Further, blade bias leak resistance was also excellent. Especially, in the developing rollers produced in Examples 9, 10, and 12, image streaks due to the deformation of the surface layer of the developing roller in a high-temperature high-humidity environment was inhibited from occurring, and the suppression of blotching and leak images in a low-temperature low-humidity environment could be achieved at a high level.

Further, the developing rollers produced in Examples 9 to 12 had a good balance among EcX, EcY, EcZ, and UrcX in the surface layer, and the amount of carbon black added was especially optimal.

The surface layer of the developing roller of Comparative Example 1 had a small amount of carbon black added, and thus image streaks were observed as the level of permanent deformation in the surface layer increased. Further, roller resistance increased, and blotching due to charging up was observed in a low-temperature low-humidity environment.

The surface layer of the developing roller of Comparative Example 2 had too high a carbon black content, and thus carbon black was not sufficiently dispersed. Further, significant blade bias leak was confirmed.

As for the developing roller of Comparative Example 3, the polyolefin skeleton was distributed in a excessively uneven state on the surface of the surface layer, and the EcX value was too low. Consequently, significant blade bias leak was detected. Further, since the polyurethane resin did not have the structures represented by chemical formulae (a) and (b), even though the EcZ value was sufficiently high, the mechanical properties were low. Therefore, image streaks due to the permanent deformation in the surface layer of the developing roller were also observed.

The surface layer of the developing roller of Comparative Example 4 had a high EcX value, and blotching was observed on the image.

The developing roller of Comparative Example 5 had a low EcZ value, and the mechanical properties were insufficient. Therefore, significant image streaks caused by deformation of the developing roller were observed.

The surface layer of the developing roller of Comparative Example 6 had a high EcZ value, and significant blade bias leak was detected. Further, due to the incompatibility of the components (D) and (E), the mechanical properties were lowered, and although the EcZ value was high, image streaks due to the permanent deformation of the surface layer of the developing roller were observed.

As to the surface layer of the developing roller of Comparative Example 7, the polyurethane resin did not include the structures represented by chemical formulae (a) and (b). This meant that the balance among EcX, EcY, and EcZ was not good, and the mechanical properties were significantly lowered. Further, image streaks due to the permanent deformation of the surface layer of the developing roller were significantly observed. Moreover, the dispersibility of the carbon black in the surface layer significantly deteriorated, and significant occurrence of blade bias leak images was observed.

The surface layer of the developing roller of Comparative Example 8 was inferior in mechanical properties and the UrcX value was too low. Therefore, significant image streaks caused by deformation of the developing roller were observed.

The surface layer of the developing roller of Comparative Example 9 had too high a UrcX value, and hence, the property of imparting charge to toner was excessively high, with the result that blotchy images were observed in a low-temperature low-humidity environment.

The surface layer of the developing roller of Comparative Example 10 did not contain a polybutadiene skeleton and a polyisoprene skeleton. Therefore, the mechanical properties were significantly lowered, and image streaks caused by deformation of the developing roller were observed. Moreover, due to incompatibility among the resin materials, the dispersibility of the carbon black significantly deteriorated, and significant occurrence of blade bias leak images was observed.

From the above, it is clearly seen that when satisfying the conditions defined in the present invention, the suppression of image streaks caused by deformation of the developing roller in a high-temperature high-humidity environment and the suppression of blotching and blade bias leak images in a low-temperature low-humidity environment can both be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-252917, filed Sep. 30, 2008, which is hereby incorporated by reference herein in its entirety.

What is claimed is:

1. A developing roller for supplying a toner to a photosensitive member and developing an electrostatic latent image formed on the photosensitive member, the developing roller provided with a surface layer comprising carbon black and a polyurethane resin, wherein the polyurethane resin has at least one selected from the group consisting of the structures represented by the following chemical formulae (a) and (b):

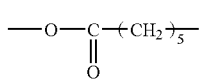

(a)

-continued (b)

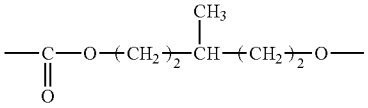

and at least one skeleton selected from the group consisting of a polybutadiene skeleton and a polyisoprene skeleton, wherein the surface layer comprises 18 parts by mass or more and 30 parts by mass or less of carbon black based on 100 parts by mass of the polyurethane resin, wherein a thickness of the surface layer is t, a surface of the surface layer is X, a depth at a position of t/4 from the surface of the surface layer is Y, and a depth at a position of t/2 from the surface of the surface layer is Z, wherein the following expressions (1) to (4) are simultaneously satisfied:

$$7.5 \leqq EcX \leqq 10.0 \quad (1)$$

$$11.0 \leqq EcZ \leqq 14.0 \quad (2)$$

$$EcX \leqq EcY \leqq EcZ \quad (3)$$

$$0.5 \leqq UrcX \leqq 2.0 \quad (4),$$

and wherein in expressions (1) to (3), EcX, EcY, and EcZ are ester group concentrations at positions X, Y, and Z, respectively, and in expression (4), UrcX is a urethane group concentration at position X.

2. A method for producing a developing roller according to claim 1, the method comprising the steps of:

forming on a periphery of the resin layer a coating film of a coating solution for surface layer formation which includes a polyurethane resin raw material mixture including a polyol, carbon black and an isocyanate compound; and curing the coating film, wherein the polyurethane resin raw material comprises:

(i) at least one of the group consisting of (D1) and (D2), and (ii) (E), wherein (D1) is a polyester polyol which has a number average molecular weight (Mn) in the range of 1,200≦Mn≦2,000, and includes at least one selected from the group consisting of the units represented by the following chemical formulae (a) and (b):

(a)

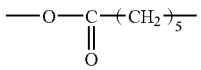

(b)

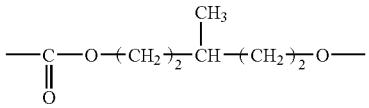

wherein (D2) is a polyol which has a number average molecular weight (Mn) in the range of 4,000≦Mn≦8,000, and includes a urethane group and at least one selected from the group consisting of the units represented by the chemical formulae (a) and (b), and wherein (E) is a polyol which has a number average molecular weight (Mn) in the range of 1,200≦Mn≦2,800, and includes at least one selected from the group consisting of a polybutadiene skeleton and a polyisoprene skeleton.

3. The method for producing a developing roller according to claim 2, wherein the polyurethane resin raw material mixture comprises (D1), and (D1) is a polyester polyol whose raw material is at least one selected from the group consisting of 3-methyl-1,5-pentanediol and caprolactone diol.

4. The method for producing a developing roller according to claim 2, wherein the polyurethane resin raw material mixture includes (D2), and (D2) is a prepolymer type ester polyol obtained by allowing a polyester polyol whose raw material is at least one selected from the group consisting of 3-methyl-1,5-pentanediol and caprolactone diol to react with an isocyanate compound.

5. A process cartridge which comprises the developing roller according to claim 1 and a photosensitive drum arranged in contact with the developing roller, and is attachable to and detachable from a main body of an electrophotographic apparatus.

6. An electrophotographic apparatus provided with the developing roller according to claim 1 and a photosensitive drum arranged in contact with the developing roller.

* * * * *